US007224925B2

(12) United States Patent
Sato et al.

(10) Patent No.: US 7,224,925 B2
(45) Date of Patent: May 29, 2007

(54) DEVELOPER FEEDING MEMBER, DEVELOPING APPARATUS, PROCESS CARTRIDGE AND DEVELOPER FEEDING MEMBER MOUNTING METHOD

(75) Inventors: Masaaki Sato, Shizuoka-ken (JP); Shigeo Miyabe, Numazu (JP); Shinjiro Toba, Mishima (JP); Hiroomi Matsuzaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 148 days.

(21) Appl. No.: 10/960,249

(22) Filed: Oct. 8, 2004

(65) Prior Publication Data

US 2006/0051135 A1 Mar. 9, 2006

(30) Foreign Application Priority Data

Sep. 8, 2004 (JP) ..... 2004-261461

(51) Int. Cl.
*G03G 15/08* (2006.01)

(52) U.S. Cl. ..... 399/263; 399/258; 399/254

(58) Field of Classification Search ..... 399/258, 399/254, 263; 366/279, 292, 309, 325.92, 366/326.1, 331; D23/41
See application file for complete search history.

(56) References Cited

U.S. PATENT DOCUMENTS

| | | | | |
|---|---|---|---|---|
| 5,331,373 | A | 7/1994 | Nomura et al. | 355/200 |
| 5,452,056 | A | 9/1995 | Nomura et al. | 355/200 |
| 5,463,446 | A | 10/1995 | Watanabe et al. | 355/200 |
| 5,528,341 | A | 6/1996 | Shishido et al. | 355/200 |
| 5,585,889 | A | 12/1996 | Shishido et al. | 355/200 |
| 5,640,650 | A | 6/1997 | Watanabe et al. | 399/117 |
| 5,681,020 | A * | 10/1997 | Buck | |
| 5,839,028 | A | 11/1998 | Nomura et al. | 399/109 |
| 5,870,654 | A | 2/1999 | Sato et al. | 399/109 |
| 5,873,012 | A | 2/1999 | Miyabe et al. | 399/90 |
| 5,878,309 | A | 3/1999 | Nomura et al. | 399/111 |
| 5,878,310 | A | 3/1999 | Noda et al. | 399/117 |
| 5,926,666 | A | 7/1999 | Miura et al. | 399/25 |
| 5,940,658 | A | 8/1999 | Yokoi et al. | 399/119 |
| 5,946,531 | A | 8/1999 | Miura et al. | 399/111 |
| 5,950,047 | A | 9/1999 | Miyabe et al. | 399/111 |
| 5,966,566 | A | 10/1999 | Odagawa et al. | 399/109 |
| 5,966,567 | A | 10/1999 | Matsuzaki et al. | 399/111 |
| 5,974,288 | A | 10/1999 | Sato | 399/119 |
| 6,011,941 | A | 1/2000 | Takashima et al. | 399/111 |

(Continued)

FOREIGN PATENT DOCUMENTS

JP 9-22173 1/1997

(Continued)

*Primary Examiner*—David M. Gray
*Assistant Examiner*—Laura K Roth
(74) *Attorney, Agent, or Firm*—Fitzpatrick, Cella, Harper & Scinto

(57) ABSTRACT

A developer feeding member for use with an electrophotographic image forming apparatus to feed a developer accommodated in a developer accommodating portion, includes a shaft for receiving a driving force to rotate when the shaft is mounted in the developer accommodating portion; a flexible sheet for feeding the developer accommodated in the developer accommodating portion when the flexible sheet is mounted in the developer accommodating portion; a mounting member for mounting the flexible sheet on the shaft such that the flexible sheet is movable relative to the shaft in a longitudinal direction, in a widthwise direction and in a thickness direction.

2 Claims, 24 Drawing Sheets

U.S. PATENT DOCUMENTS

| | | | | |
|---|---|---|---|---|
| 6,029,031 | A | 2/2000 | Yokomori et al. | 399/109 |
| 6,064,843 | A | 5/2000 | Isobe et al. | 399/111 |
| 6,072,968 | A | 6/2000 | Nomura et al. | 399/113 |
| 6,075,957 | A | 6/2000 | Batori et al. | 399/114 |
| 6,097,906 | A | 8/2000 | Matsuzaki et al. | 399/90 |
| 6,104,894 | A | 8/2000 | Sato et al. | 399/106 |
| 6,128,452 | A | 10/2000 | Miyabe et al. | 399/90 |
| 6,131,007 | A | 10/2000 | Yamaguchi et al. | 399/256 |
| 6,144,815 | A | 11/2000 | Chadani et al. | 399/27 |
| 6,154,623 | A | 11/2000 | Suzuki et al. | 399/111 |
| 6,173,140 | B1 | 1/2001 | Suzuki et al. | 399/113 |
| 6,173,145 | B1 | 1/2001 | Chadani et al. | 399/265 |
| 6,188,856 | B1 | 2/2001 | Sato | 399/119 |
| 6,215,969 | B1 | 4/2001 | Nomura et al. | 399/111 |
| 6,219,504 | B1 | 4/2001 | Matsuzaki et al. | 399/92 |
| 6,282,389 | B1 | 8/2001 | Matsuzaki et al. | 399/111 |
| 6,351,620 | B1 | 2/2002 | Miyabe et al. | 399/111 |
| 6,381,420 | B1 | 4/2002 | Sato et al. | 399/27 |
| 6,405,004 | B2 | 6/2002 | Matsuzaki et al. | 399/111 |
| 6,415,121 | B1 | 7/2002 | Suzuki et al. | 399/111 |
| 6,424,811 | B1 | 7/2002 | Tsuda et al. | 399/167 |
| 6,463,225 | B1 * | 10/2002 | Abe et al. | 399/254 |
| 6,519,431 | B1 | 2/2003 | Toba et al. | 399/111 |
| 6,549,736 | B2 | 4/2003 | Miyabe et al. | 399/111 |
| 6,603,939 | B1 | 8/2003 | Toba et al. | 399/103 |
| 6,640,066 | B2 | 10/2003 | Sato | 399/106 |
| 6,678,488 | B2 | 1/2004 | Toba et al. | 399/111 |
| 6,714,749 | B2 | 3/2004 | Sato et al. | 399/102 |
| 6,792,229 | B2 | 9/2004 | Matsuzaki | 399/111 |
| 6,795,666 | B2 | 9/2004 | Miyabe et al. | 399/109 |
| 6,836,629 | B2 | 12/2004 | Miyabe et al. | 399/111 |
| 2002/0131790 | A1 | 9/2002 | Sato et al. | 399/111 |
| 2002/0159787 | A1 | 10/2002 | Chadani et al. | 399/109 |
| 2002/0191981 | A1 | 12/2002 | Miyabe et al. | 399/90 |
| 2003/0235429 | A1 | 12/2003 | Sato et al. | 399/111 |
| 2004/0037590 | A1 | 2/2004 | Morioka et al. | 399/167 |
| 2005/0100367 | A1 * | 5/2005 | Uratani et al. | 399/254 |

FOREIGN PATENT DOCUMENTS

| | | |
|---|---|---|
| JP | 2001-75343 | 3/2001 |
| JP | 2001-92224 | 4/2001 |
| JP | 2004264674 A * | 9/2004 |

* cited by examiner (a)

(b)

(c)

DEVELOPER FEEDING MEMBER, DEVELOPING APPARATUS, PROCESS CARTRIDGE AND DEVELOPER FEEDING MEMBER MOUNTING METHOD

FIELD OF THE INVENTION AND RELATED ART

The present invention relates to a developer conveying member, a developing apparatus, a process cartridge, and a method for attaching a developer conveying member.

Here, an electrophotographic image forming apparatus is an apparatus for forming an image on a recording medium with the use of an electrophotographic image forming process. For example, an electrophotographic copying machine, an electrophotographic printer (for example, an LED printer, a laser beam printer, etc.), an electrophotographic facsimile machine, an electrophotographic word processor, etc., can be included in the category of an electrophotographic image forming apparatus.

A process cartridge is a cartridge which is removably mountable in the main assembly of an electrophotographic image forming apparatus, and in which a minimum of a developing means as a processing means, and an electrophotographic photosensitive member, are integrally placed in order to make them removably mountable in the main assembly of the image forming apparatus.

A process cartridge system has long been employed in the field of an electrophotographic image forming apparatus. A process cartridge system is a system which employs a process cartridge which is removably mountable in the main assembly of an electrophotographic image forming apparatus, and in which a minimum of a developing means as a processing means, and an electrophotographic photosensitive member, are integrally placed in order to make them removably mountable in the main assembly of the image forming apparatus. A process cartridge system makes it possible for a user to maintain an electrophotographic image forming apparatus by himself, without relying on a service person, substantially improving operational efficiency. Therefore, it is widely used in the field of an image forming apparatus.

In some process cartridges, an electrophotographic photosensitive member and a developing apparatus are integrally placed, and the developing apparatus in these process cartridges is provided with a developer storage portion for storing developer. In the developer storage portion, a developer conveying member for conveying the developer in the developer storage portion is provided. Generally, a developer conveying member is made up of a rotational shaft, and a piece of a flexible sheet fixed to the rotational shaft.

As for a method, in accordance with the prior art, for attaching the flexible sheet to the rotational shaft, the method in which the flexible sheet is held to the rotational shaft by fixing a sheet pressing plate to the rotational shaft with small screws, adhesive, heat (thermal crimping), ultrasonic waves (ultrasonic welding), etc., while holding the flexible sheet pinched between the rotational shaft and the sheet pressing plate, has been known (Japanese Laid-open Patent Application 9-022173 and Japanese Laid-open Patent Application 2001-075343).

Also has been known is the structural arrangement which relatively loosely anchors the stirring sheet (flexible sheet) to the rotational shaft in order to allow the stirring sheet to move relative to the rotational shaft in the direction parallel to the shorter edge of the stirring sheet (Japanese Laid-open Patent Application 2001-092224).

However, when the above-described methods, in accordance with the prior art, for attaching the flexible sheet to the shaft of the developer conveying member, for example, the method which attaches the flexible sheet to the shaft of a developer conveying member with the use of an additional member, the method which attaches the flexible sheet to the shaft by thermally or ultrasonically crimping the flexible sheet anchoring projections or the like of the shaft, or the method which thermally or ultrasonically welds the flexible sheet to the shaft by melting the flexible sheet anchoring projections or the like of the shaft, the flexible sheet was likely to become rippled. Therefore, when any of the above-described methods or the like is used to attach the flexible sheet to the shaft, special attention had to be paid to prevent the flexible sheet from becoming rippled, in order to ensure that the developer is reliably conveyed.

SUMMARY OF THE INVENTION

Thus, the primary object of the present invention is to prevent a flexible sheet attached to a rotational shaft, from rippling.

Another object of the present invention is to provide a developer conveying member capable of preventing the flexible sheet of the developer conveying member from rippling even if the developer storage portion of a developing apparatus is structured so that the flexible sheet comes into, or remains in contact with the internal surface of the developer container, a developing apparatus comprising such a developer conveying member, a process cartridge comprising such a developing apparatus, and a method for installing such a developing conveying member.

Another object of the present invention is to provide a developer conveying member capable of reliably conveying the developer in the developer storage portion of a developing apparatus, a developing apparatus comprising such a developer conveying member, a process cartridge comprising such a developing apparatus, and a method for installing such a developing conveying member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Next, the first embodiment of the present invention will be described. First, referring to FIGS. 1 and 2, an electrophotographic image forming apparatus in which the process cartridge in the first embodiment is mountable will be described.

Figure 1:
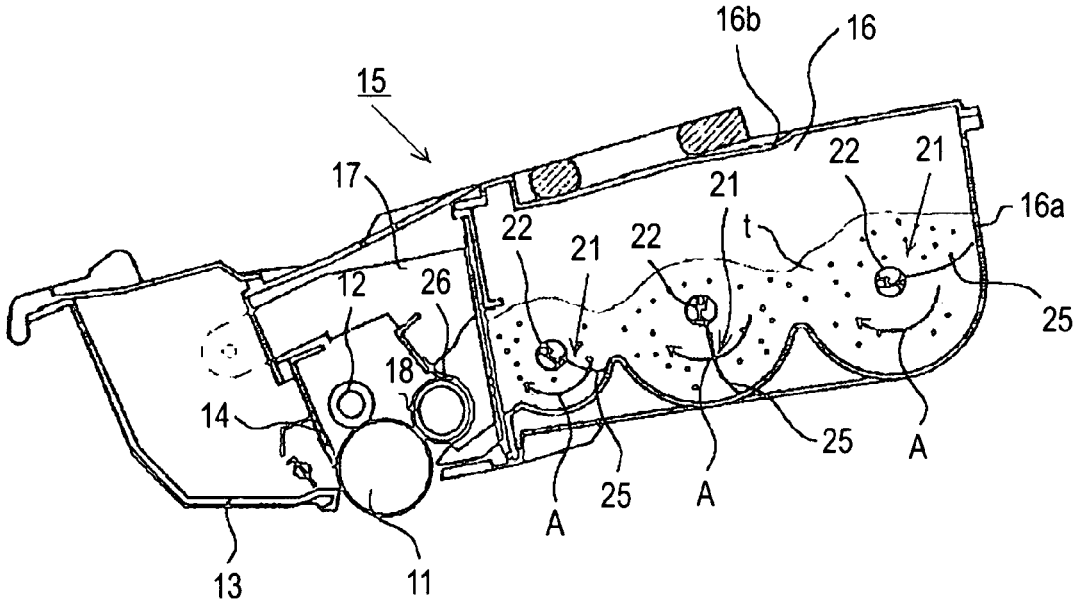
FIG. 1 is a sectional view of the process cartridge in the first embodiment of the present invention, at a plane perpendicular to the lengthwise direction of the process cartridge.
Figure 2:
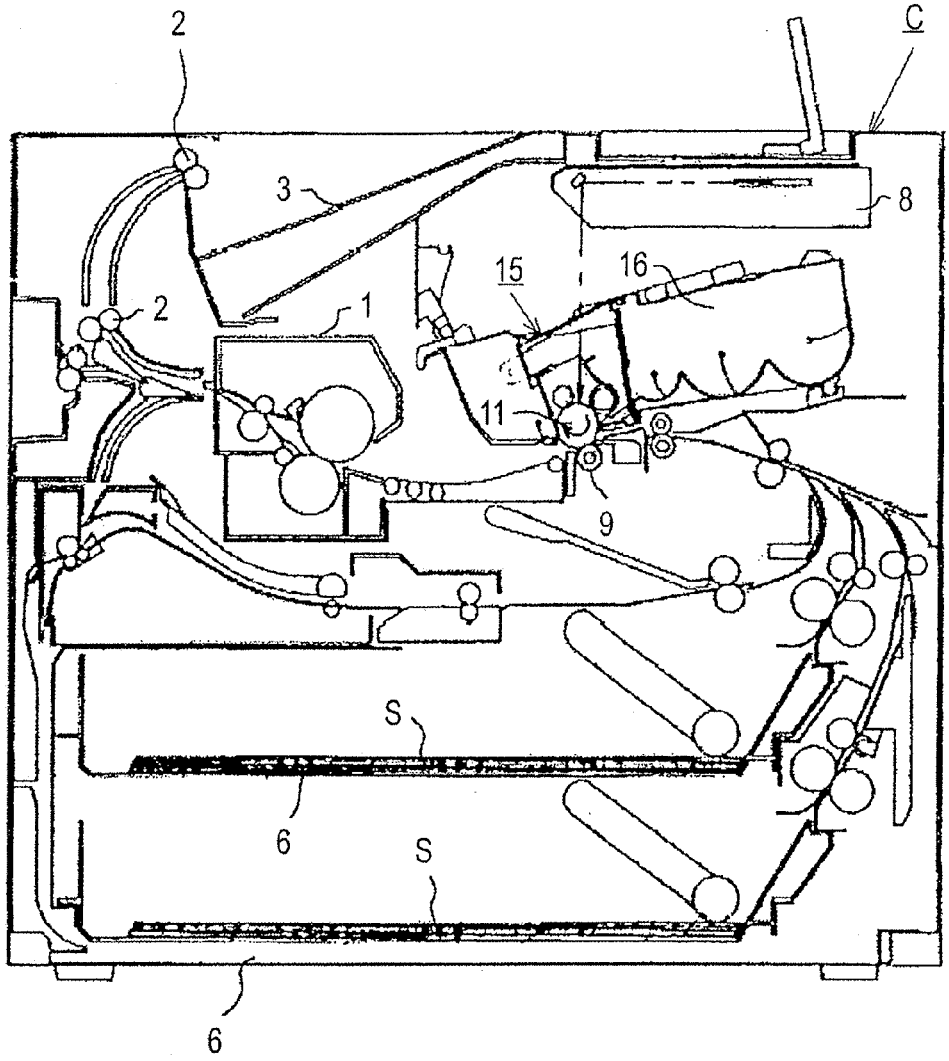
FIG. 2 is a sectional view of the electrophotographic image forming apparatus in the first embodiment of the present invention, at a plane perpendicular to the lengthwise direction of the process cartridge.

FIG. 1 is a sectional view of the process cartridge 15, which is mounted into the main assembly C of an electrophotographic image forming apparatus (which hereinafter will be referred to simply as the "apparatus main assembly") to be used for image formation. Referring to FIG. 2, the electrophotographic photosensitive drum (which hereinafter will be referred to simply as the "photosensitive drum") 11 is rotationally driven in the clockwise direction indicated by an arrow mark. The charge roller 12 uniformly charges to a predetermined potential level the photosensitive drum 11 while the photosensitive drum 11 is rotated. Meanwhile, a recording medium S is conveyed from the cassette 6 mounted in the bottom portion of the apparatus main assembly. In synchronism with the conveyance of the recording medium S, numerous points of the charged peripheral surface of the photosensitive drum 11 are selectively exposed by the exposing apparatus 8. As a result, an electrostatic latent image is formed on the peripheral surface of the photosensitive drum 11. Thereafter, the developer t in the developer container 16 is placed on the peripheral surface of the development blade 26. Then, as development bias is applied to the development roller 18, the developer is supplied to the peripheral surface of the photosensitive drum 11, in the pattern of the electrostatic latent image; in other words, the electrostatic latent image is developed into a visible image, or a developer image (image formed of developer). This developer image is transferred onto the recording medium S, by the bias (voltage) applied to the transfer roller 9. Then, the recording medium S, onto which the developer image has just been transferred, is sent into the fixing apparatus 1, in which the developer image is fixed to the recording medium. Thereafter, the recording medium S is discharged by the pair of discharge rollers 2 into the delivery tray 3 on top of the apparatus main assembly. After the separation of the recording medium, the transfer residual developer (residual developer), that is, the developer remaining on the peripheral surface of the photosensitive drum 11 after the transfer of the developer image, is removed by the cleaning blade 14, and the photosensitive drum 11 is used for the next image formation operation. After being removed from the photosensitive drum 11, the transfer residual toner is stored in the cleaning means frame (which hereinafter will be referred to simply as the "developer container") 13, which is a container for storing the removed developer.

Referring to FIG. 1, the cartridge 15 in this embodiment comprises the photosensitive drum 11, the charge roller 12, the development roller 18 as a charging means, the development blade 26, and the developer container 16 in which developer is stored. The charge roller 12, the development roller 18, the development blade 26, and the developer container 16 are placed in the adjacencies of the peripheral surface of the photosensitive drum 11. Further, the cartridge 15 comprises the cleaning blade 14 as a cleaning means. The cartridge 15 also comprises a housing in which the above-mentioned components are integrally placed, and is removably mountable in the apparatus main assembly C. The developing apparatus comprises: a developing means frame 17 for holding the development roller 18; and the developer container 16 as the developer storing portion in which developer is stored.

Figure 3A:
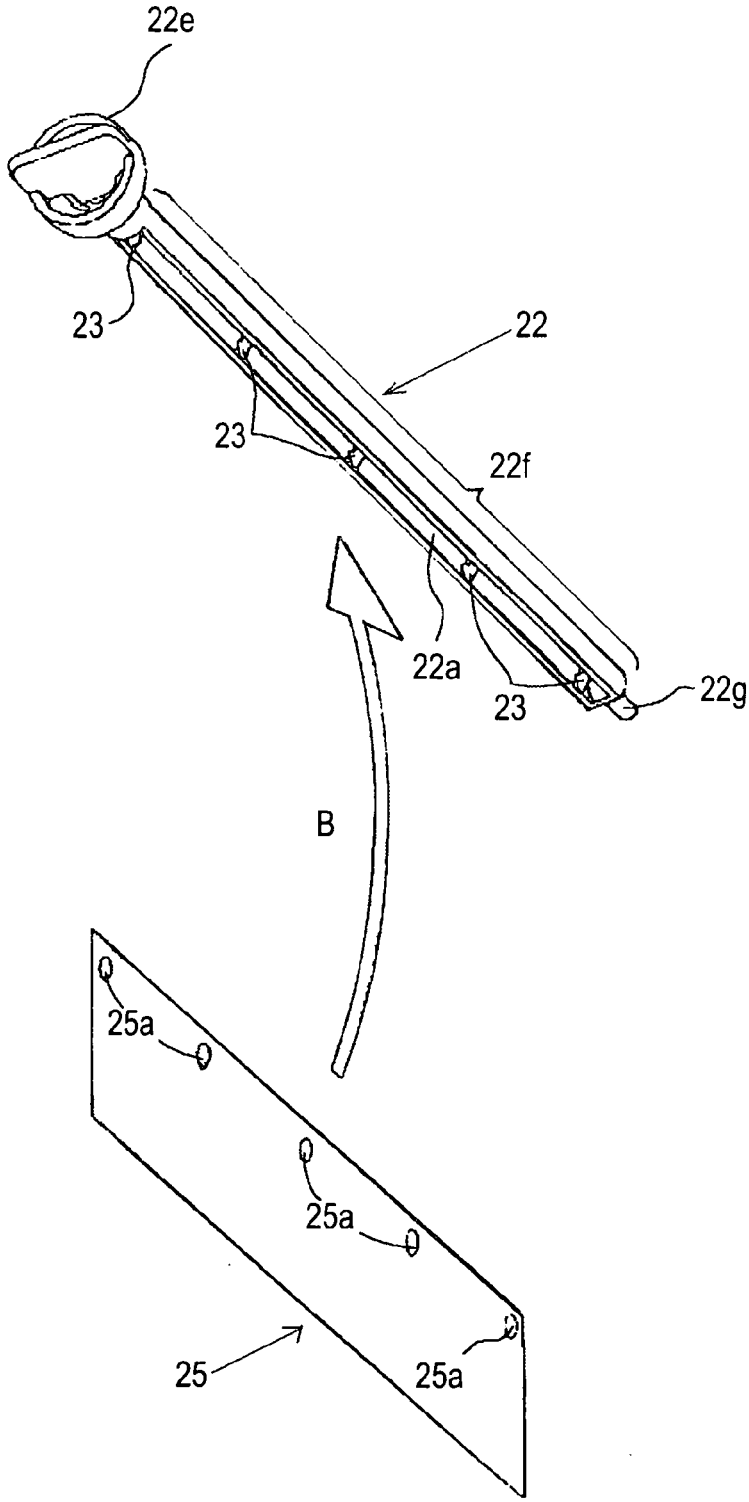
FIG. 3*a* is an exploded perspective view of the developer conveying member in the first embodiment, showing the method for assembling the developer conveying member.
Figure 3B:
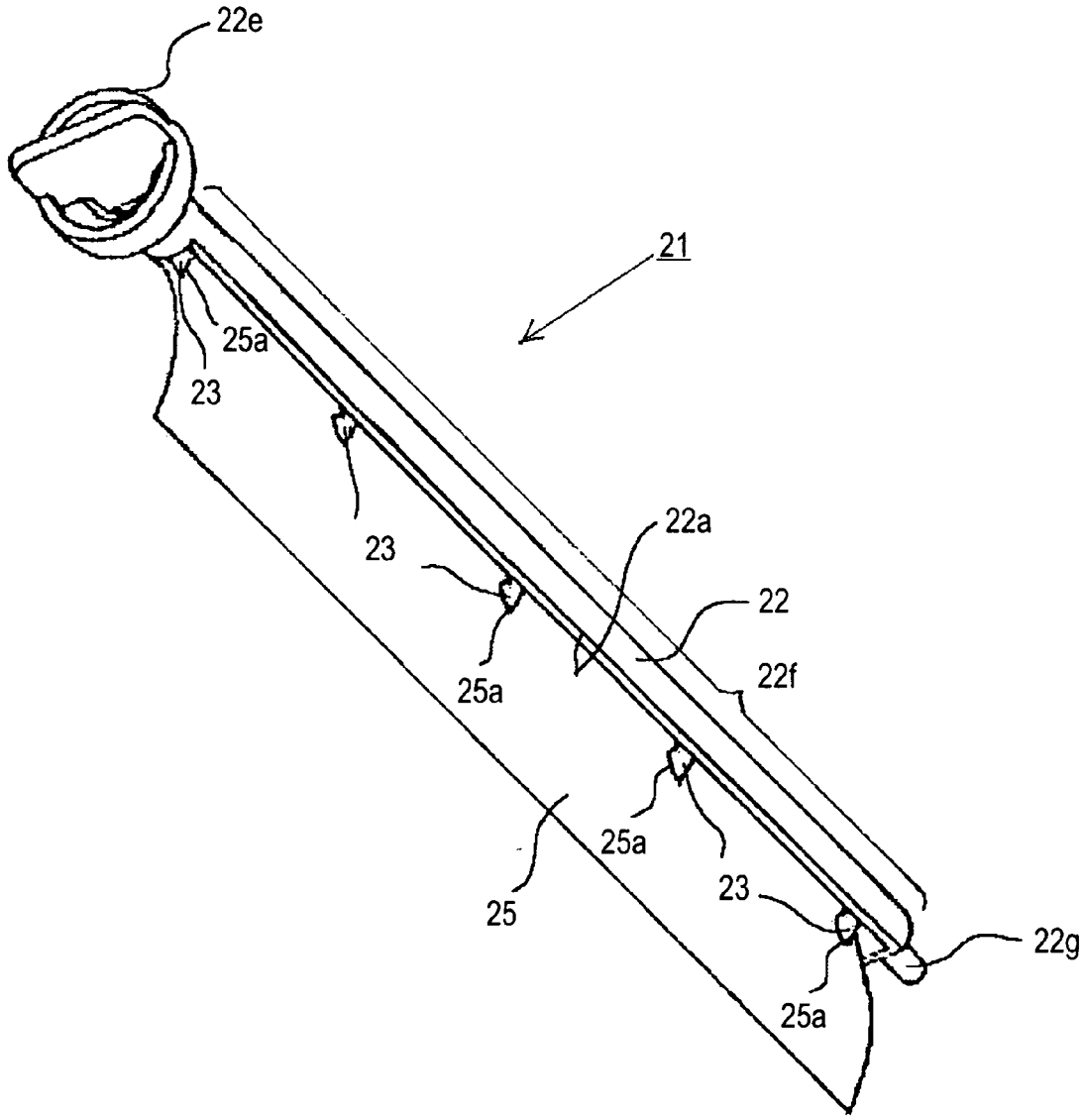
FIG. 3*b* is a perspective view of the developer conveying member in the first embodiment.

At this time, the structure for conveying the developer in the developer container 16 will be described. Hereinafter, the lengthwise direction is the direction parallel to the axis of the photosensitive drum 11. The developer t in the developer container 16 is conveyed toward the development roller 18 by the developer conveying member (which hereinafter will be referred to simply as the "conveying member") 21, as the conveying member 21 is rotated in the direction indicated by an arrow mark A (FIG. 1). The conveying member 21 is rotatably supported by the developer container 16. Referring to FIGS. 3*a* and 3*b*, the conveying member 21 comprises a rotational shaft (which hereinafter may be referred to as "conveying shaft") 22, and a flexible sheet 25 fixed to the conveying shaft 22.

Next, referring to FIGS. 3*a* and 3*b*, the conveying shaft 22 has a main portion 22*f*, a driving force transmitting portion 22*e*, and a sliding portion 22*g*, which are integral parts of a single-piece conveying shaft 22. To the main portion 22*f*, the flexible sheet 25 is attached by one of its lengthwise edges (ends in terms of widthwise direction of the flexible sheet 25), with the lengthwise edge set parallel to the main portion 22*f*. The driving force transmitting portion 22*e* is attached to one of the lengthwise ends of the main portion 22*f*, and receives a driving force (torque) from the apparatus main assembly C, when the cartridge 15 is in the apparatus main assembly C. The driving force transmitting portion 22*e* has a driving force transmitting means such as gears, coupler, etc. The sliding portion 22*g* is attached to the other end of the main portion 22*f*, and is rotatably supported by one of the walls of the developer container 16. Incidentally, the conveying shaft 22 is attached to the developer container 16 before the flexible sheet 25 is attached to the conveying shaft 22.

Figure 4:
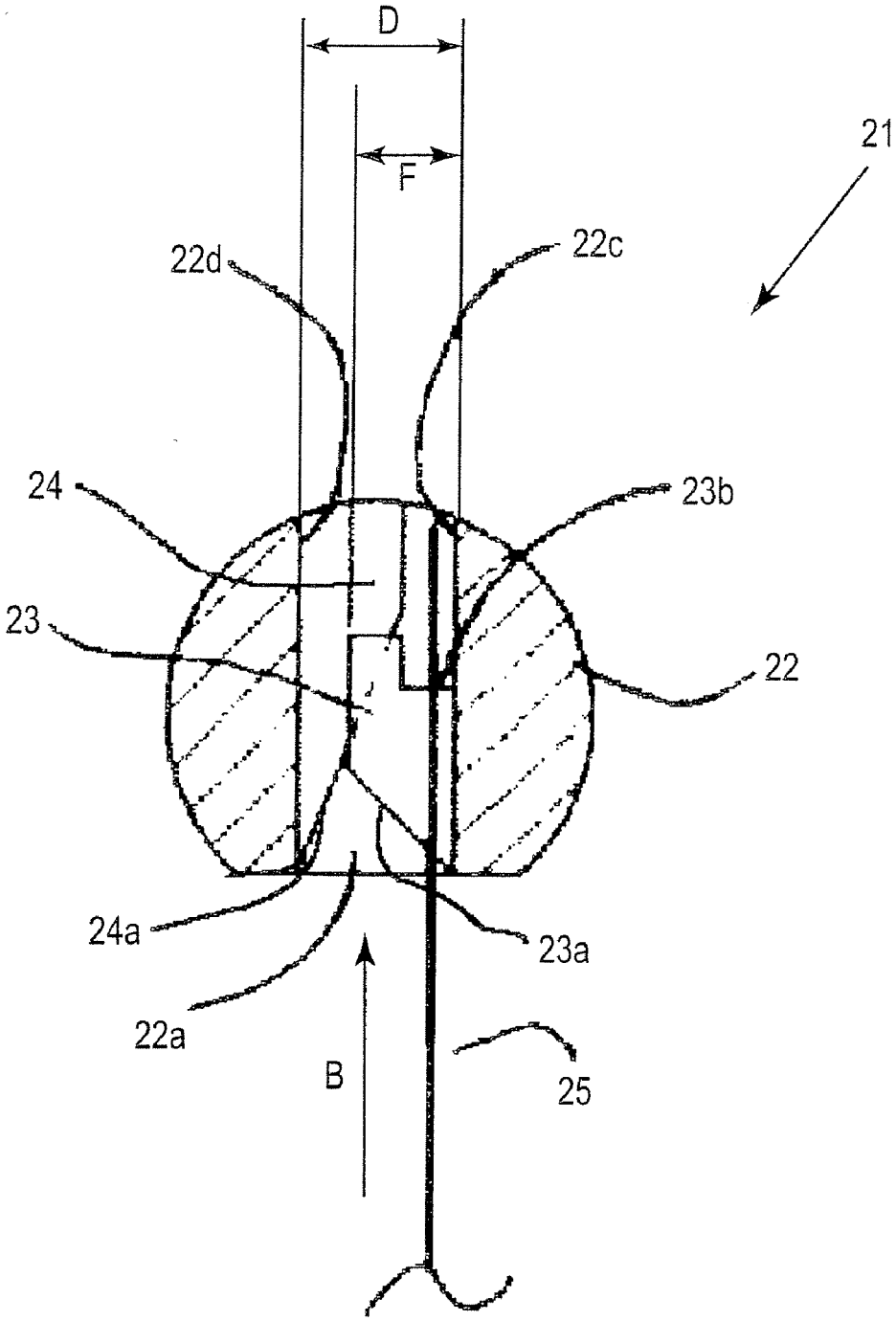
FIG. 4 is a sectional view (No. 1) of the developer conveying member in the first embodiment, showing the structure thereof.
Figure 5:
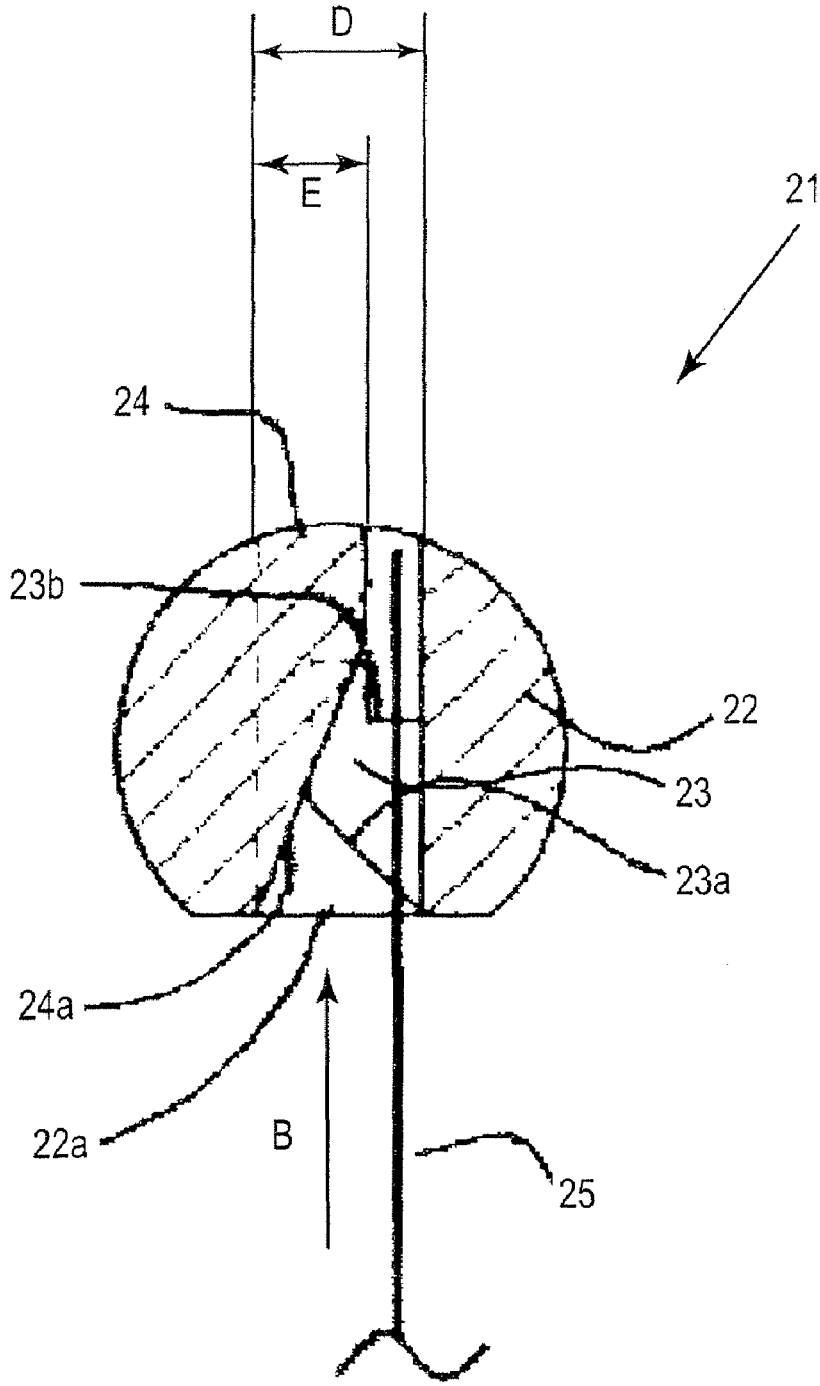
FIG. 5 is a sectional view (No. 2) of the developer conveying member in the first embodiment, showing the structure thereof.
Figure 6:
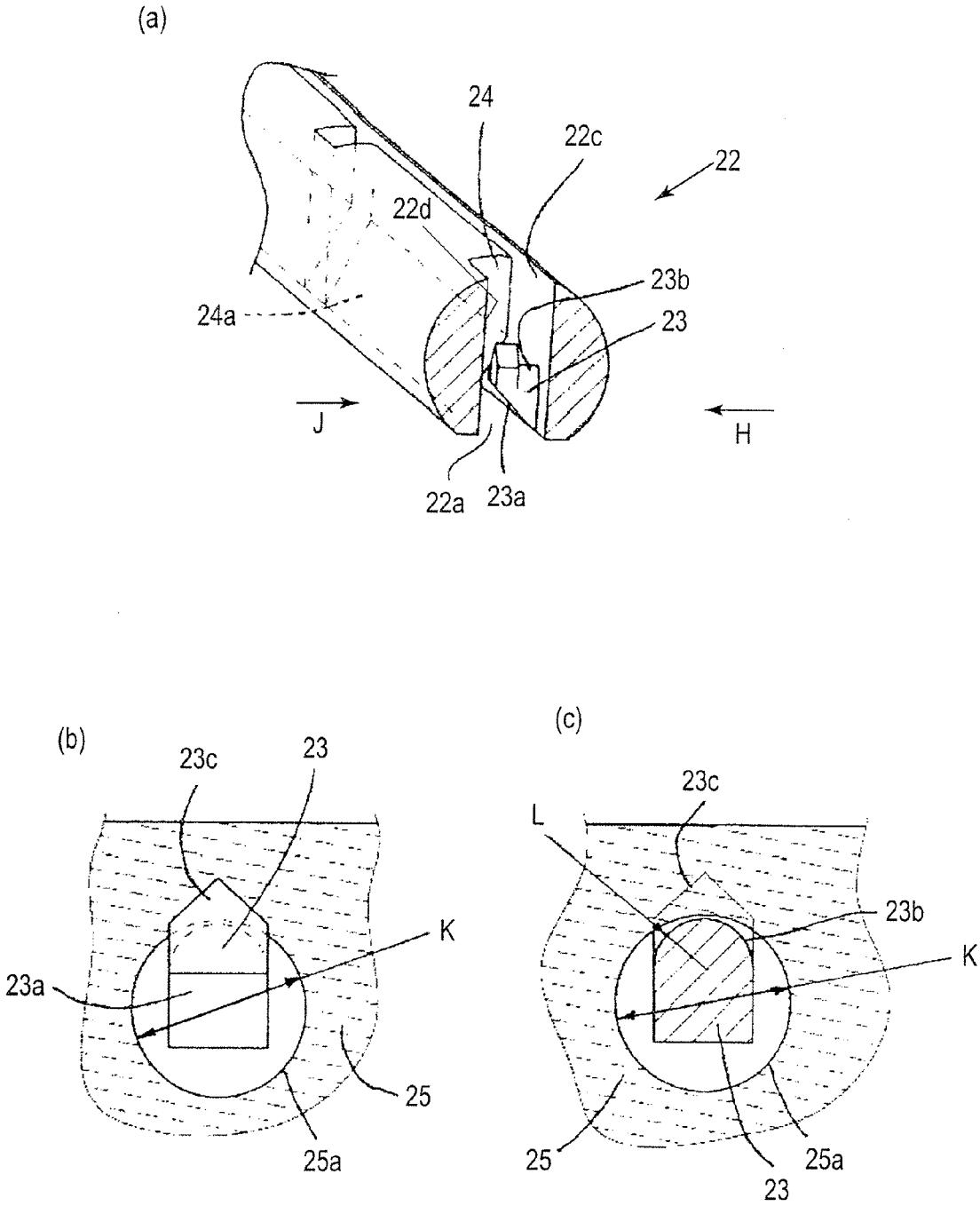
FIG. 6(*a*) is a perspective view of a part of the rotational shaft of the developer conveying member in the first embodiment, showing the structure thereof for anchoring the flexible sheet to the rotational shaft, and FIGS. 6(*b*) and 6(*c*) are sectional views of one of the flexible sheet anchoring claws.

FIG. 4 is a sectional view of one of the flexible sheet anchoring claws 23 of the conveying shaft 22, and FIG. 5 is a sectional view of one of the flexible sheet retaining portions 24 for keeping the flexible sheet 25 anchored to the conveying shaft 22. FIG. 6(*a*) is a perspective view of one of the plurality of flexible sheet anchoring portions of the conveying shaft 22. As shown in FIGS. 3*a* and 3*b*, the conveying shaft 22 has a plurality of flexible sheet anchoring portions for anchoring the flexible sheet 25 to the conveying shaft 22. The conveying shaft 22 has a long slit 22*a* which extends in the lengthwise direction of the conveying shaft 22. Referring to FIG. 4, one of the lengthwise edges portion of the flexible sheet 25 is fitted in the slit 22*a*. The flexible sheet anchoring claw 23 fits into the anchoring hole 25*a* of the flexible sheet 25. The flexible sheet anchoring claw 23 is a projection attached to (integral with) the conveying shaft 22, and functions as a member for anchoring the flexible sheet 25 to the conveying shaft 22. In this embodiment, the flexible sheet anchoring claw 23 is in the form of a hook.

Figure 7:
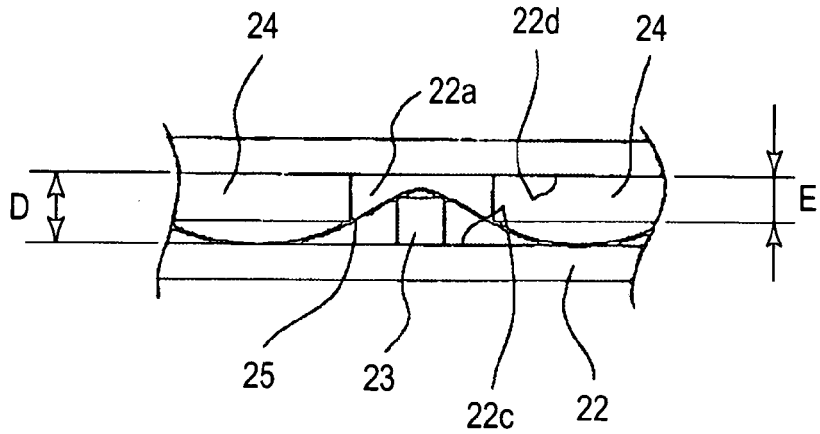
FIGS. 7(*a*), 7(*b*), and 7(*c*) are schematic drawings for illustrating the steps for assembling the developer conveying member in the first embodiment.
Figure 7:
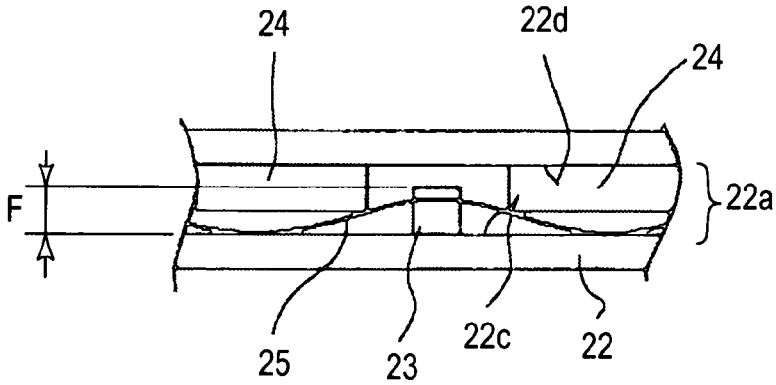
Figure 7:
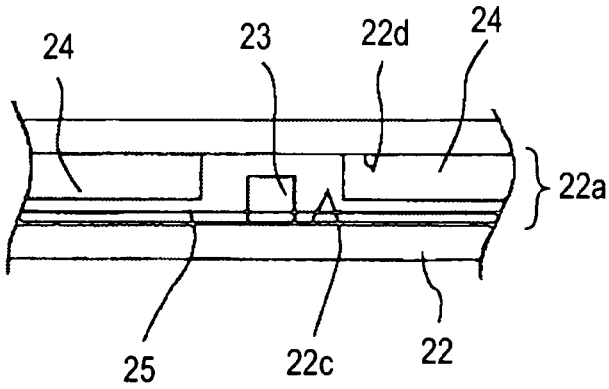

Next, how to anchor the flexible sheet 25 to the conveying shaft 22 will be described. Referring to FIGS. 4 and 5, the conveying shaft 22 is provided with a predetermined number of ribs 24 as a means for preventing the flexible sheet 25 from becoming disengaged from the flexible sheet anchoring claw 23 (preventing the flexible sheet anchoring claw 23 from coming out of the anchoring hole 25*a* of the flexible sheet 25). The ribs 24 are located within the aforementioned slit 22*a*, in which the aforementioned flexible sheet anchoring claws 23 are also located. Referring to FIG. 4, the height of the flexible sheet anchoring claw 23 is roughly ⅔ of the width D of the slit 22*a*. In this embodiment, the width D of the slit 22*a* is roughly 3 mm, whereas the height F of the flexible sheet anchoring claw 23 is roughly 2 mm. Referring to FIG. 7, designated by reference characters 22*c* is one of the opposing surfaces of the slit 22*a*, which obviously extends in the lengthwise direction of the slits 22*a* (the same direction as the lengthwise direction of the flexible sheet 25 after its attachment to the conveying shaft 22). The aforementioned claws 23 project from this surface 22*c*. Designated by reference characters 22*d* is the other of the opposing two surfaces of the slit 22*a*. The surface 22*d* is provided with a predetermined number of ribs 24, which are aligned in the lengthwise direction of the conveying shaft 22, with the provision of intervals large enough to accommodate one of the claws 23, so that as seen from the lengthwise direction, the ribs 24 and claws 23 are alternately positioned, in other words, the claws 23 are positioned between the adjacent two ribs 24. Each rib 24 is provided with a slanted portion 24*a*. Each claw 23 is provided with a slanted portion 23*a* (FIGS. 4 and 5), making it easier to insert the flexible sheet 25 into the slit 22*a* in the direction indicated by an arrow mark B (FIG. 3*a*), because the slanted portions 23*a*, 24*a* can be used to guide the anchoring hole 25*a* of the flexible sheet 25 to the flexible sheet anchoring claw 23. Referring to FIG. 5, the height E of the rib 24 is roughly ⅔ of the width D of the slit 22*a*, and is roughly 2 mm.

Next, it will be described how to attach the flexible sheet 25 to the conveying shaft 22. FIGS. 7(*a*)–(*c*) are views of one of the portions of the conveying shaft 22, which has one of the claws 23, and the flexible sheet 25 fitted in the slit 22*a* of the conveying shaft 22, as seen from the direction indicated by the arrow mark B in FIGS. 4 and 5. The flexible sheet 25 is to be inserted into the slit 22*a* of the conveying shaft 22, from one of the lengthwise edges (end in terms of widthwise direction of flexible sheet 25, that is, the side having the anchoring holes 25*a*), in the arrow B direction in FIGS. 3*a*, 4 and 5. As the flexible sheet 25 is nudged, it begins to enter the slit 22*a* while deforming in the pattern of the gap between the claws 23 and ribs 24 because of its flexibility, as shown in FIG. 7(*a*). Then, the claws 23 begin to enter the anchoring holes 25*a* of the flexible sheet 25 as shown in FIG. 7(*b*). Then, the claws 23 completely enter the anchoring holes 25*a*, one for one, and the flexible sheet 25 becomes flat again because of its resiliency, as shown in FIG. 7(*c*). FIGS. 6(*b*) and 6(*c*) show the positional relationship between the flexible sheet anchoring claw 23 and anchoring hole 25*a* after the flexible sheet anchoring claw 23 has fully entered the hole 25*a* (flexible sheet 25 has been satisfactorily anchored by claws 23). FIG. 6(*b*) is a view of the flexible sheet anchoring claw 23 as seen from the direction indicated by an arrow mark J in FIG. 6(*a*), and FIG. 6(*c*) is a view of the flexible sheet anchoring claw 23 as seen from the direction indicated by an arrow mark H in FIG. 6(*a*), that is, as seen from the base side of the flexible sheet anchoring claw 23. The portion 23*b* of the flexible sheet anchoring claw 23, which holds the flexible sheet 25, is roughly semicylindrical. The flexible sheet holding portion 23*b* of the flexible sheet anchoring claw 23 is allowed to come into contact with the edge of the anchoring hole 25*a* of the flexible sheet 25. The radius L of this semicylindrical portion of the flexible sheet anchoring claw 23 is smaller than that of the anchoring hole 25*a*. In other words, the cross section of the flexible sheet holding portion 23*b* of the flexible sheet anchoring claw 23 is smaller than that of the anchoring hole 25*a*, making it easier to guide the flexible sheet anchoring claw 23 into the anchoring hole 25*a*. In addition, it is possible to allow the flexible sheet anchoring claw 23 to be loosely fitted in the anchoring hole 25*a*, making it possible to spread the force which applies to edge of the anchoring hole 25*a* as the flexible sheet 25 is rotated by the rotation of the conveying shaft 22, and therefore, preventing the edge of the anchoring hole 25*a* of the flexible sheet 25 from being torn by the above described force. Referring to FIGS. 6(*a*) and 6(*b*), the flexible sheet anchoring claw 23 is loosely fitted in the anchoring hole 25*a*. Therefore, the flexible sheet 25 is allowed to move relative to the conveying shaft 22 in the lengthwise direction, as well as thickness direction (rotational direction of the flexible sheet), of the flexible sheet 22, by the distance equal to the gap between the flexible sheet anchoring claw 23 and the edge of the anchoring hole 25*a*, and the distance equal to the length of the flexible sheet holding portion 23*b* of the flexible sheet anchoring claw 23, respectively. In this embodiment, the flexible sheet 25 is allowed to move relative to the conveying shaft 22, also in the widthwise direction (radius direction of the sweeping range of the sheet), which is roughly perpendicular to both the lengthwise as well as thickness direction of the flexible sheet 25.

In this embodiment, the diameter K of the anchoring hole 25*a* is roughly 4.6 mm, and the radius L of the semicylindrical portion of the flexible sheet holding portion 23*b* of the flexible sheet anchoring claw 23 is roughly 1.5 mm. The flexible sheet anchoring claw 23 has an end portion 23*c* which perpendicularly projects from the flexible sheet holding portion 23*b* of the flexible sheet anchoring claw 23. This portion 23*c* is the portion which makes it difficult for the flexible sheet 25 to disengage from the conveying shaft 22. The flexible sheet anchoring claw 23 is in the form of a hook made up of the flexible sheet holding portion 23*b*, and the portion 23*c* perpendicular to the portion 23*b*. Further, referring to FIGS. 7(*a*)–7(*c*), in order to prevent the flexible sheet 25 from disengaging from the conveying shafts 22, the internal surface 22*d* of the slit 22, which opposes the internal surface 22*c* of the slit 22, is provided with the aforementioned ribs 24 aligned in the lengthwise direction of the conveying shaft 22, with the intervals in which the plurality of claws 23 fit one for one. Thus, the flexible sheet 25 comes into contact with the ribs 24 before it allows any of the flexible sheet anchoring claws 23 to come out of the anchoring holes 25*a*, being prevented from disengaging from the claws 23 (conveying shaft 22). To sum up, the movements of the flexible sheet 25 in the lengthwise and widthwise directions of the flexible sheet 25 are regulated by the contact between the flexible sheet anchoring claws 23 and the edges of the corresponding anchoring holes 25*a* of the flexible sheet 25, and the movement of the flexible sheet 25 in its thickness direction is regulated by the contact between the flexible sheet 25 and the ribs 24, and the contact between the flexible sheet 25 and the internal surface 22*c* of the slit 22. Even after the satisfactory anchoring of the flexible sheet 25 to the conveying shaft 22, the flexible sheet 25 is allowed to remain slightly loose relative to the conveying shaft 22 as described before. Therefore, it is unlikely for a substantial amount of force to be applied from the conveying shaft 22 to the flexible sheet 25. Besides, even if a substantial amount of force is applied from the conveying shaft 22 to the flexible sheet 25, the deformation of the flexible sheet 25 can be absorbed by the edge portion of the flexible sheet 25, on the conveying shaft side. Therefore, the opposite edge portion of the flexible sheet 25 from the conveying shaft 22 is unlikely to deform in the form of a ripple. Therefore, the developer conveying member 21 can reliably convey the developer.

Figure 19:
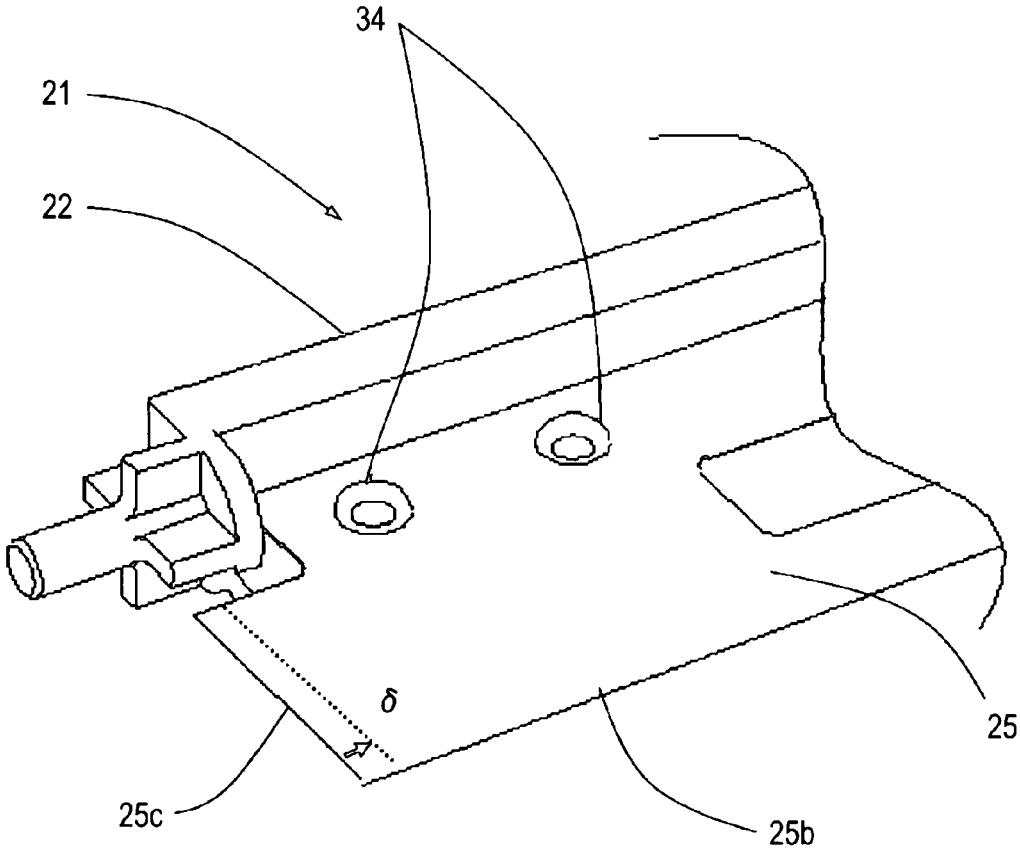
FIG. 19 is a perspective view (No. 1) for illustrating the comparative example of the developer conveying member.

Shown in FIG. 19 is one of the comparative examples of the structural arrangement used to attach the flexible sheet 25 to the conveying shaft 22. In the case of this structural arrangement, if such means as small screws, heat (thermal crimping), ultrasonic waves (ultrasonic crimping), etc., are used to attach the flexible sheet 25 to the conveying shaft 22, stress is generated in the portion of the flexible sheet 25 in the adjacencies of the joint 34 between the flexible sheet 25 and the conveying shaft 22. In addition, no gap is provided between the flexible sheet 25 and conveying shaft 22 at the joint 34. Therefore, the flexible sheet 25 is deformed by the stress generated in the portion of the flexible sheet 25 in the adjacencies of the joint 34. It is possible that this stress in the flexible sheet 25 will travel to the opposite edge 25*b* of the flexible sheet 25 from the joint 34, and cause the edge 25*b* to ripple.

In comparison, in the case of such a structural arrangement as the above-described structural arrangement in this embodiment for anchoring the flexible sheet 25 to the conveying shaft 22, the portion of the flexible sheet 25 in the adjacencies of the joint 34 is allowed to relatively freely deform. Therefore, it is difficult for the force from the conveying shaft 22 to concentrate on a specific portion of the flexible sheet 25 in the adjacencies of the joint 34, making it unlikely for stress to be generated in the portion of the flexible sheet 25 in the adjacencies of the joint 34. The force that otherwise might generate stress throughout the flexible sheet 25 is released by the portion of the flexible sheet 25 in the adjacencies of the joint 34, making it unlikely for the edge 25*b* of the flexible sheet 25 opposite from the joint 34 to ripple.

Next, referring to FIGS. 3*a*, and 8–12, the method for installing the developer conveying member 21 into the developer container 16 will be described. The conveying member 21 is attached to the developer container 16 following sequentially the steps shown in FIGS. 8, 10, 11, and 12. FIG. 9 is a sectional view of the developer container 16 in the state shown in FIG. 8, at a plane coincident with the rotational axis of the conveying member 21 and perpendicular to the bottom wall of the developer container 16.

First, a sealing member 33 (FIG. 9) in the form of a ring is to be fitted around the through hole 16*c* of the developer container shell 16*a*. The sealing member 33 is for preventing the developer from leaking from the developer container 16.

Figure 8:
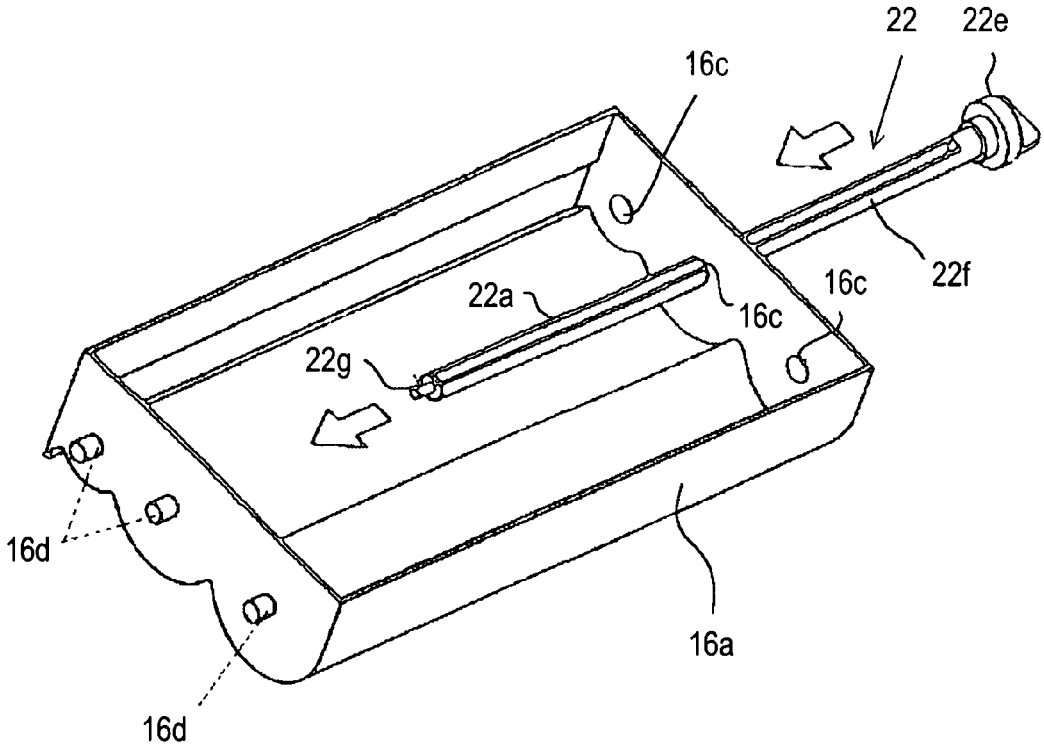
FIG. 8 is a perspective view (No. 1) for illustrating how the developer conveying member is attached to the developer storage frame, in the first embodiment.
Figure 9:
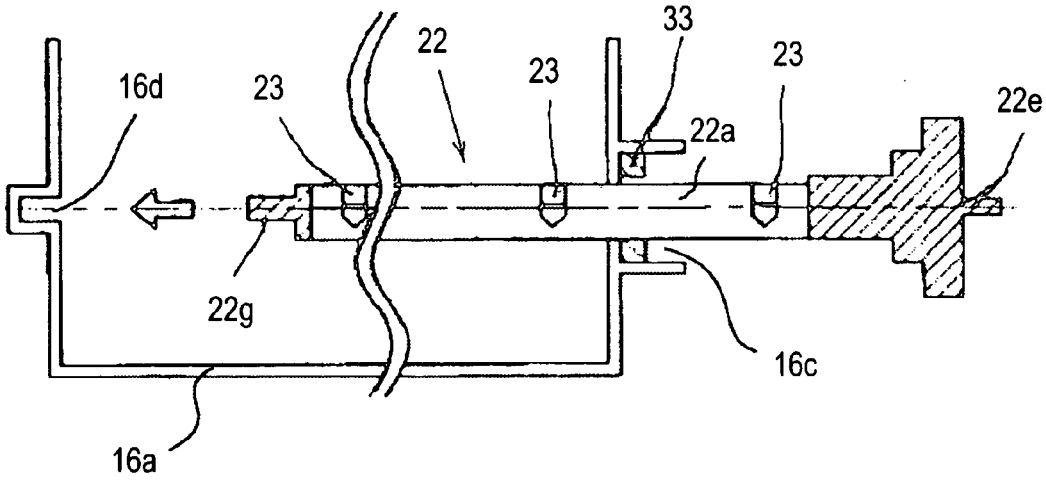
FIG. 9 is a sectional view (No. 2) for illustrating how the developer conveying member is attached to the developer storage frame, in the first embodiment.

Next, referring to FIGS. 8 and 9, the conveying shaft 22 is put through the through hole 16*c*, from the lengthwise end 22*g*, so that the lengthwise end 22*g* will be fitted into the hole 16*d*, which is not a through hole, and is located on the directly opposite side of the developer container shell 16*a* from the through hole 16*c*. As the conveying shaft 22 is placed as described above, the lengthwise end 22*g* of the conveying shaft 22 is rotatably supported by the developer container shell 16*a* (wall of the through hole 16*c*).

Figure 10:
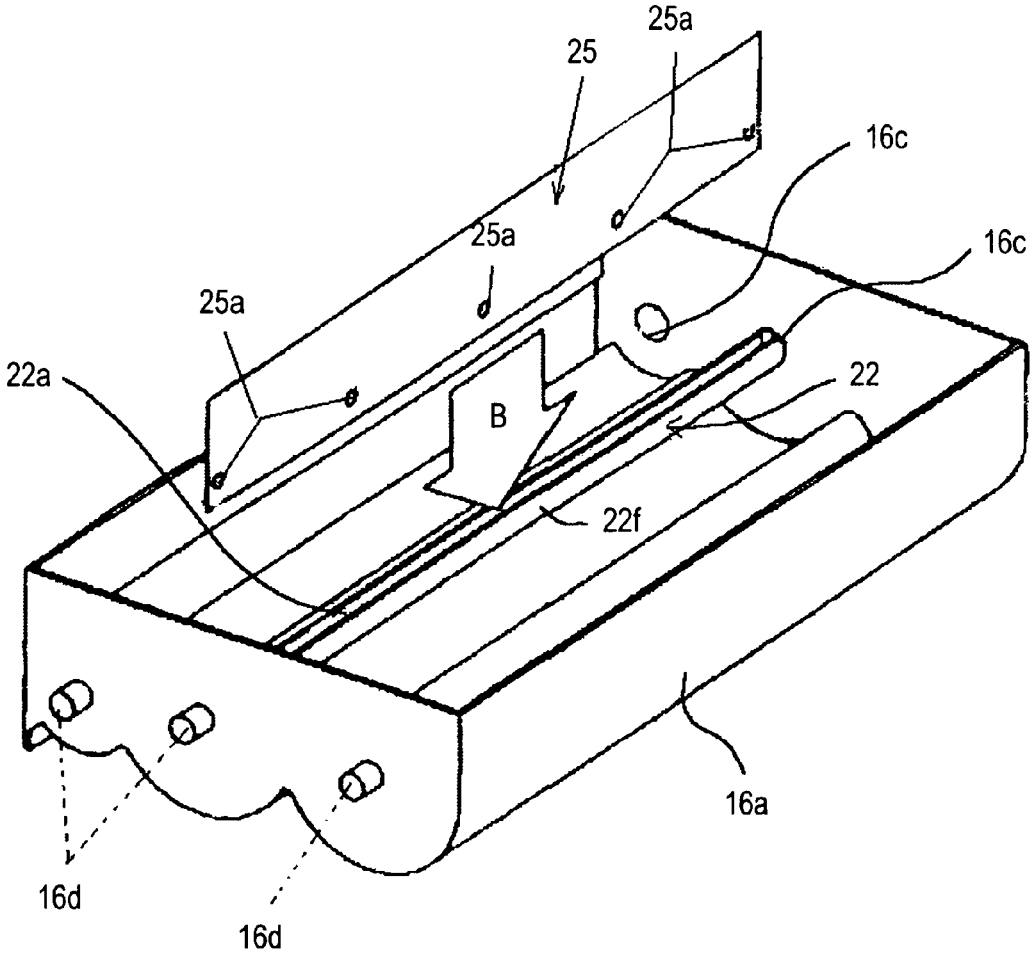
FIG. 10 is a perspective view (No. 3) for illustrating how the developer conveying member is attached to the developer storage frame, in the first embodiment.
Figure 11:
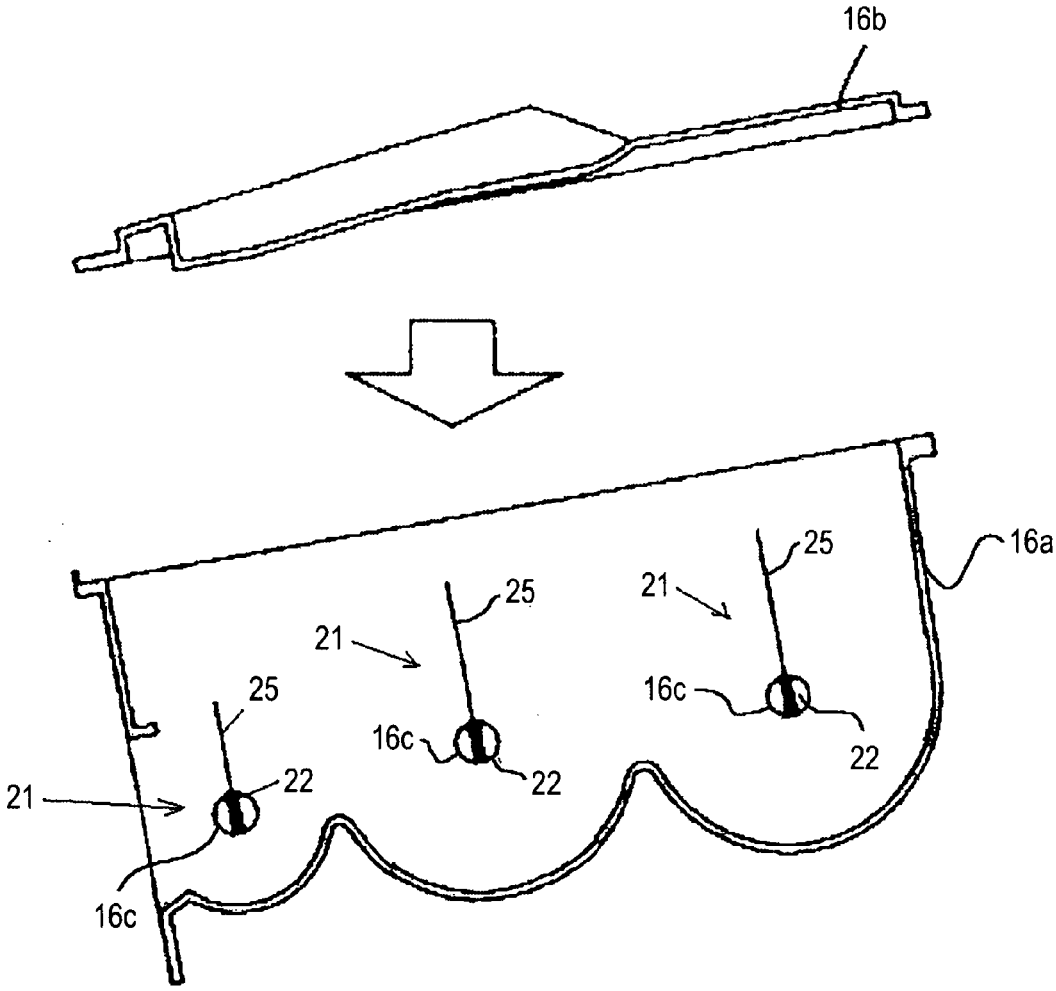
FIG. 11 is a schematic view (No. 4) for illustrating how the developer conveying member is attached to the developer storage frame, in the first embodiment.
Figure 12:
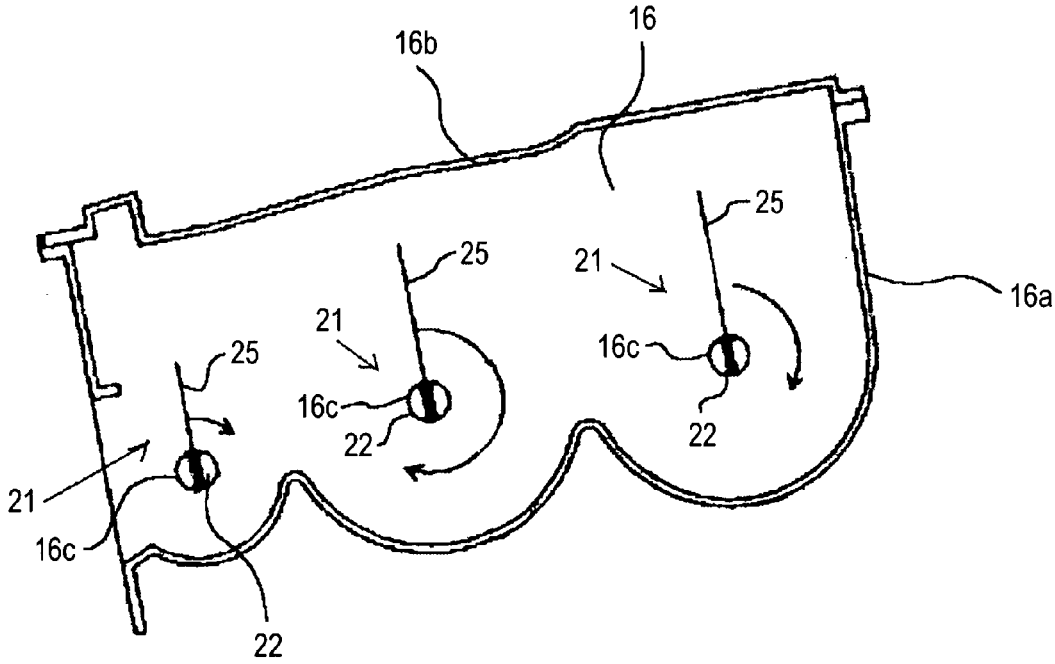
FIG. 12 is a schematic view (No. 5) for illustrating how the developer conveying member is attached to the developer storage frame, in the first embodiment.

Next, referring to FIGS. 10 and 3*a*, the conveying shaft 22 is positioned so that the slit 22*a* faces upward (toward lid 16*b* of developer container 16). Then, the flexible sheet 25 is to be inserted into the slit 22*a*, with the slit 22*a* facing upward as described above, so that the aforementioned flexible sheet anchoring claws 23 of the conveying shaft 22 fit into the anchoring holes 25*a* of the flexible sheet 25. Then, the lid 16*b* of the developer container 16 is to be welded to the developer container shell 16*a* with the use of ultrasonic waves, heat, or the like.

As described above, the conveying member 21 in this embodiment has the rotatable conveying shaft 22, and the flexible sheet 25, which is attached to the conveying shaft 22 by one of the lengthwise edges (end in terms of widthwise direction of the sheet). Thus, as the flexible sheet 25 is rotated by the rotation of the conveying shaft 22, the developer is conveyed. The flexible sheet 25 is provided with the plurality of anchoring holes 25*a*, which are located along one of the lengthwise edges thereof, and the conveying shaft 22 is provided with the slit 22*a*, into which the portion of the flexible sheet 25 having the anchoring holes 25*a* is inserted. Within the slit 22*a*, the plurality of anchoring claws 23 which fit into the plurality of anchoring holes 25*a* of the flexible sheet 25, one for one, and the plurality of ribs 24, are alternately positioned in the lengthwise direction of the conveying shaft 22. More specifically, the plurality of flexible sheet anchoring claws 23 project from the internal surface 22*c* of the slit 22*a*, whereas the plurality of ribs 24 project from the internal surface 22*d* of the slit 22*a*, which directly opposes the internal surface 22*c*. Further, in terms of the lengthwise direction, the ribs 24 and claws 23 are alternately positioned. With the provision of the above-described structural arrangement, the flexible sheet 25 does not ripple while or after it is anchored to the conveying shaft 22.

Moreover, with the provision of the above-described structural arrangement, the flexible sheet 25 can be anchored to the conveying shaft 22 simply by inserting the flexible sheet 25 into the slit 22*a* of the conveying shaft 22, eliminating the need for the tools necessary if the flexible sheet 25 is to be attached to the conveying shaft 22 by direct thermal welding, ultrasonic welding, or the like method. Further, since no tool is required to attach the flexible sheet 25 to the conveying shaft 22, it is possible to attach the flexible sheet 25 to the conveying shaft 22, while the shaft 22 is within the developer container shell 16*a*; in other words, it is possible to attach the flexible sheet 25 to the conveying shaft 22 after the conveying shaft 22 is fully inserted into the developer container shell 16*a*.

Further, in the case of the conveying member 21, the flexible sheet 25 of which had to be attached to the conveying shaft 22 after the flexible sheet 25 was attached to the conveying shaft 22, the driving force transmitting member had to be attached to the conveying shaft 22 from outward of the developer container shell after the placement of the conveying shaft 22 into the developer container shell. Therefore, the driving force transmitting member must be a component independent from the conveying shaft 22, adding to the number of assembly steps. In comparison, in the case of the conveying member 21 in this embodiment, the flexible sheet 25 can be attached to the conveying shaft 22 after the conveying shaft 22 is completely inserted to the developer container shell 16*a*. Therefore, the main portion 22*f* and the driving force transmitting portion 22*e* of the conveying shaft 22 can be formed as integral parts of the single-piece conveying shaft 22.

Forming the conveying shaft 22 having the main portion 22*f* and the driving force transmitting portion 22*e* in a single piece reduces the component cost, and also, the assembly cost, and therefore, substantially reduces the cost of the developer conveying member, and substantially improves the developer conveying member in assembly efficiency as well as quality.

Embodiment 2

Next, the second embodiment of the present invention will be described. This embodiment is such a case that, in order to convey the waste developer in the waste toner container 13 for storing the residual developer after the residual developer is removed from the peripheral surface of the electrophotographic photosensitive drum 11, the conveying member 21 placed in the developing apparatus in the first embodiment is placed in the waste toner container 13.

Figure 13:
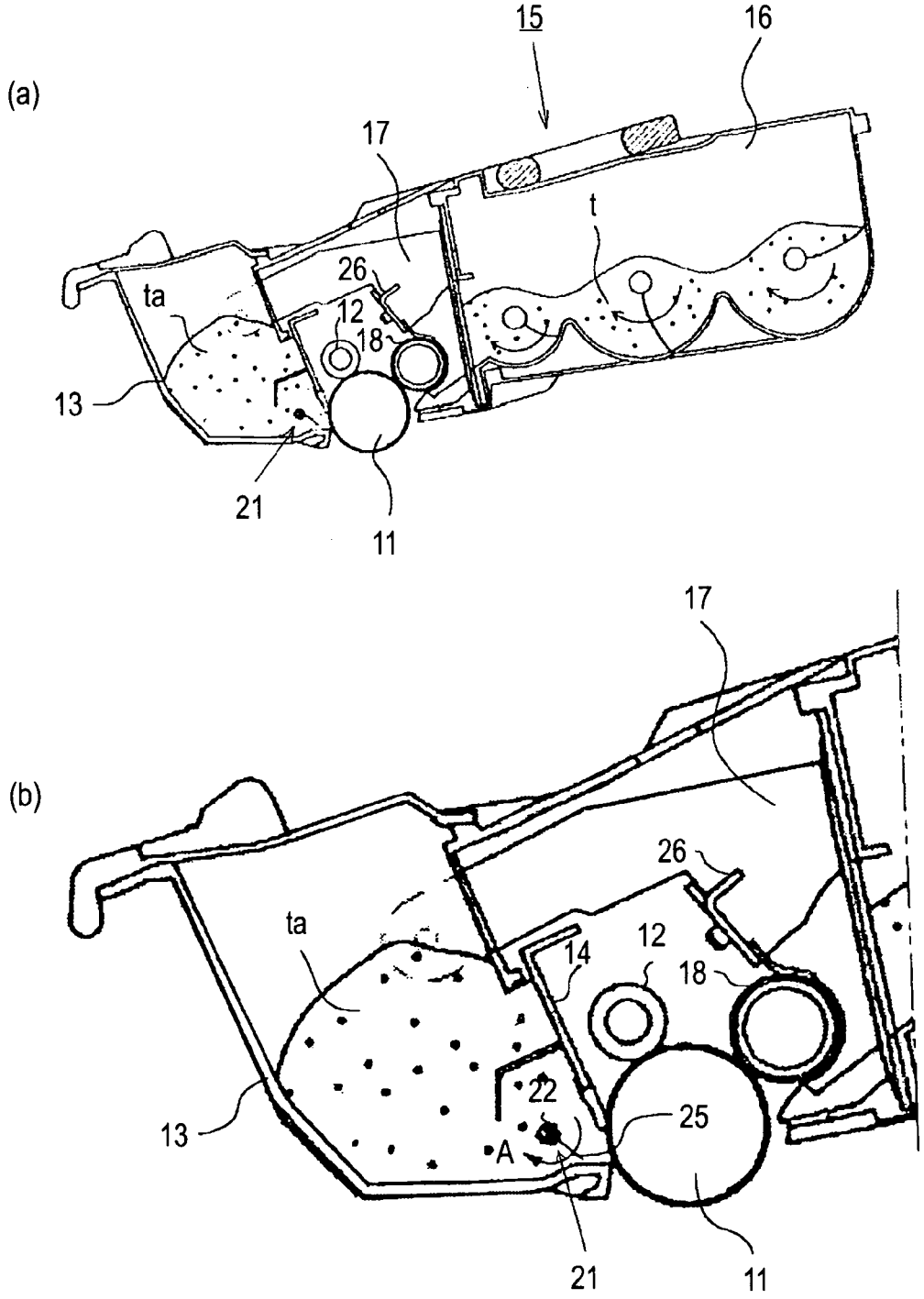
FIG. 13*a* is a sectional view of the process cartridge in the second embodiment of the present invention, at a plane perpendicular to the lengthwise direction of the cartridge.
FIG. 13*b* is an enlargement of the portion of the FIG. 13*a* pertinent to the description of the first embodiment.
Figure 14:
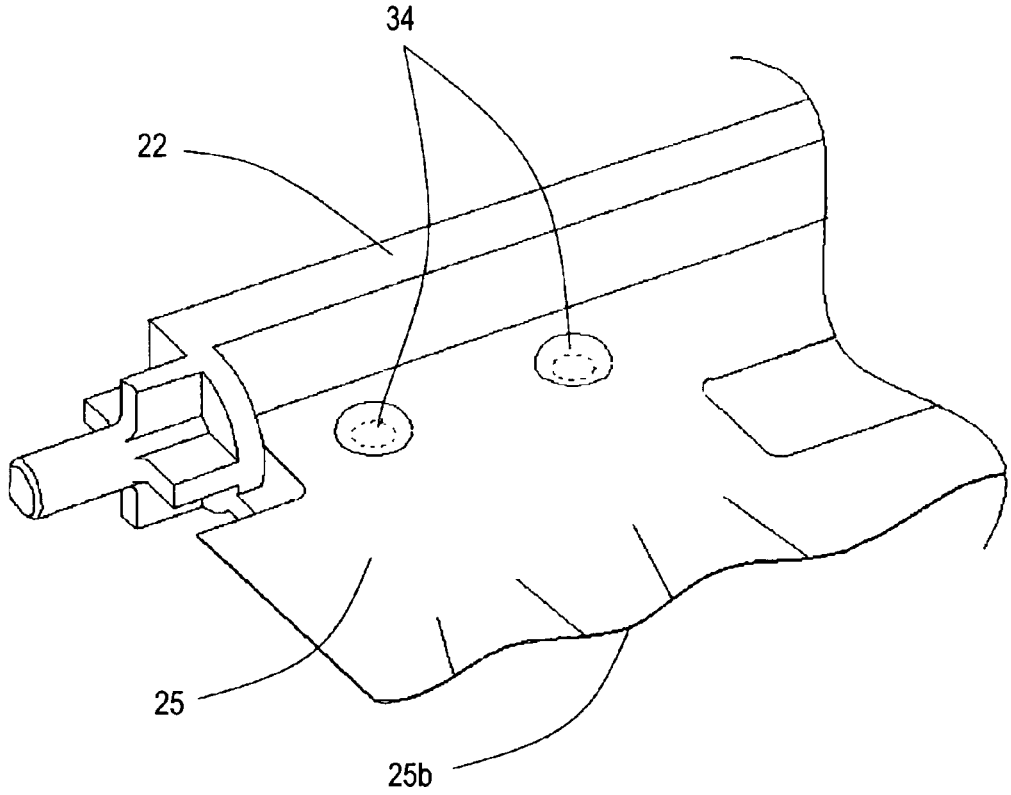
FIG. 14 is a perspective view of one of the lengthwise ends of the comparative example of the developer conveying member, showing how the flexible sheet is attached to the rotational shaft.

Referring to FIG. 13, the structure of the process cartridge 15 in this embodiment will be described. FIG. 13(*a*) is a sectional view of the cartridge 15, at a plane perpendicular to the lengthwise direction of the cartridge 15, and FIG. 13(*b*) is an enlarged sectional view of the portion of FIG. 13(*a*) pertinent to this embodiment. The cartridge 15 in this embodiment comprises the photosensitive drum 11, the charge roller 12, the development roller 18, the development blade 26, the developer container 16 in which developer t is stored, and the cleaning blade 14 as a cleaning means. The charge roller 12, the development roller 18, the development blade 26, the developer container 16, and the cleaning blade 14, are placed in the adjacencies of the peripheral surface of the photosensitive drum 11. The cartridge 15 also comprises a housing in which the abovementioned components are integrally placed, and which is removably mountable in the apparatus main assembly C. The structure of the main assembly of the image forming apparatus in this embodiment is the same as the main assembly C of the image forming apparatus in the first embodiment shown in FIG. 2, and therefore, will not be described here.

At this time, the internal structure of the waste developer container 13 as the waste toner storage portion, for conveying the waste toner ta will be described. The transfer residual developer, or the developer remaining on the peripheral surface of the photosensitive drum 11 after the transfer of the developer image onto the recording medium S, is removed by the cleaning blade 14, and the removed transfer residual developer is stored in the waste developer container 13. In the waste developer container 13, the developer conveying member 21 is rotated in the direction indicated by an arrow mark A in FIG. 13(*b*), and therefore, the removed waste developer ta is conveyed inward (side opposite to photosensitive drum 11) of the waste developer container 13 by the developer conveying member 21. The waste developer conveying member 21 has the conveying shaft 22 rotatably supported by the remove waste developer container 13, and a flexible sheet 25 anchored to the conveying shaft 22.

Next, the method for installing the conveying member 21 into the frame of the removed waste developer container 13 will be described. This is the same as the method for installing the developer conveying member 21 into the developer container 16, in the first embodiment. That is, first, the conveying shaft 22 is inserted into the removed waste developer container 13. It should be noted here that the conveying shaft 22 is inserted into the removed waste developer container 13 before the cleaning blade 14 is attached to the removed waste developer container 13. Then, the flexible sheet 25 is inserted into the slit (22*a*) of the conveying shaft 22, anchoring thereby the flexible sheet 25 to the conveying shaft 22. The method, in this embodiment, for anchoring the flexible sheet 25 to the conveying shaft 22 is the same as that in the first embodiment, and therefore, will not be described here to avoid the repetition of the same description. Thereafter, the development unit frame 17 is attached to the removed waste developer container (cleaner unit frame) 13. In this embodiment, the flexible sheet 25 can be attached to the conveying shaft 22 after the conveying shaft 22 is fully inserted into the removed waste developer container 13. Therefore, it is possible to form, in a single piece, the conveying shaft 22 of the conveying member 21 having the main portion and driving force transmitting portion (22*e*), as it is in the first embodiment. Therefore, not only can the conveying member 21 be reduced in component count, but also, it can be improved in assembly efficiency. Therefore, it is possible to reduce the conveying member 21 in cost.

Incidentally, the first and second embodiments of the present invention may be combined. In other words, the developer conveying member in the developer container 16, and the removed waste developer conveying member in the removed waste developer container 13, may be employed in combination to achieve both the effects obtainable by the first embodiment, and the effects obtainable by the second embodiment.

Embodiment 3

Next, the third embodiment of the present invention will be described. The main assembly of the image forming apparatus, the process cartridge, and the developing apparatus, in this embodiment are the same in structure as those in the first embodiment. Therefore, their structures will not be described to avoid the repetition of the same description.

At this time, referring to FIG. 15, the developer t stored in the developer container 16, and the structure of the removed waste developer conveying shaft 22 of the removed waste developer conveying member 21, and the structure of the flexible sheet 25, in this embodiment, will be described.

Figure 15:
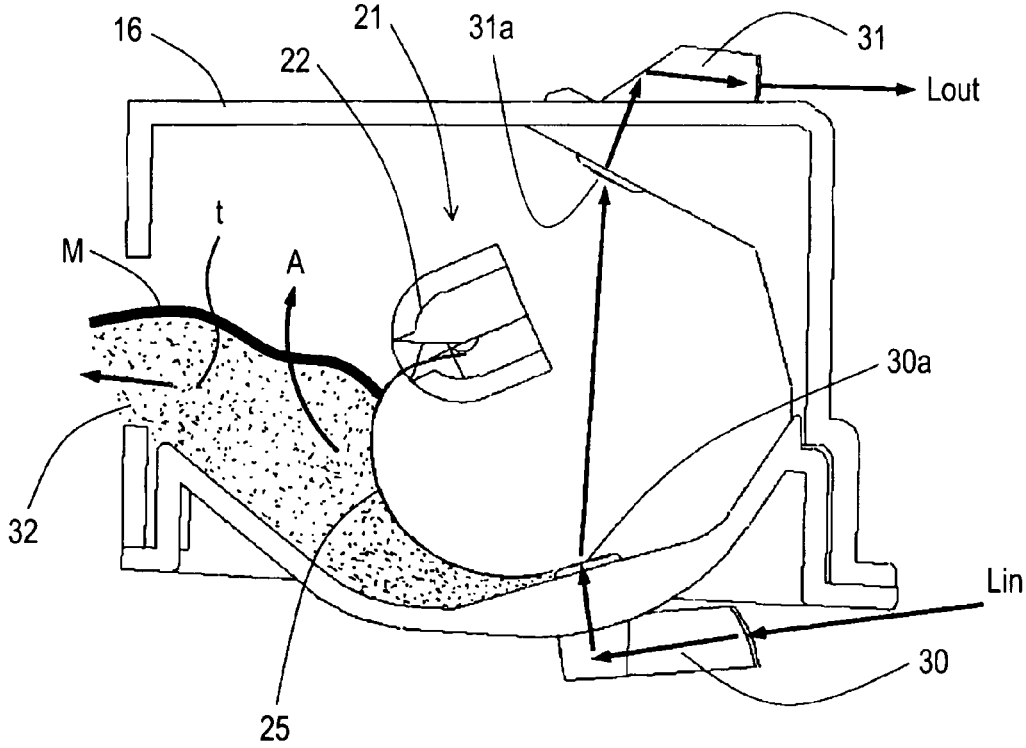
FIG. 15 is a sectional view (No. 1) for illustrating the developer storage portion in the third embodiment of the present invention.

FIG. 15 is a sectional view of the developer container 16. The removed waste developer conveying member 21 comprising the conveying shaft 22 and the flexible sheet 25 is rotated in the direction indicated by an arrow mark A in the drawing, by the driving force received through the driving force transmitting member (unshown).

The flexible sheet 25 is rotated in the developer container 16 while remaining in contact with the bottom wall as well as the top wall of the developer container 16. Therefore, the flexible sheet 25 deforms in a manner to conform to the shape of the developer container 16 as shown in the drawing. As the conveying member 21 is rotated, the developer t is conveyed to the development roller (unshown) through the developer delivery opening 32. Designated by a reference letter M is the top surface of the body of the developer (interface between the body of the developer and body of air in the internal space of the developer container 16 not occupied by body of developer).

Figure 16:
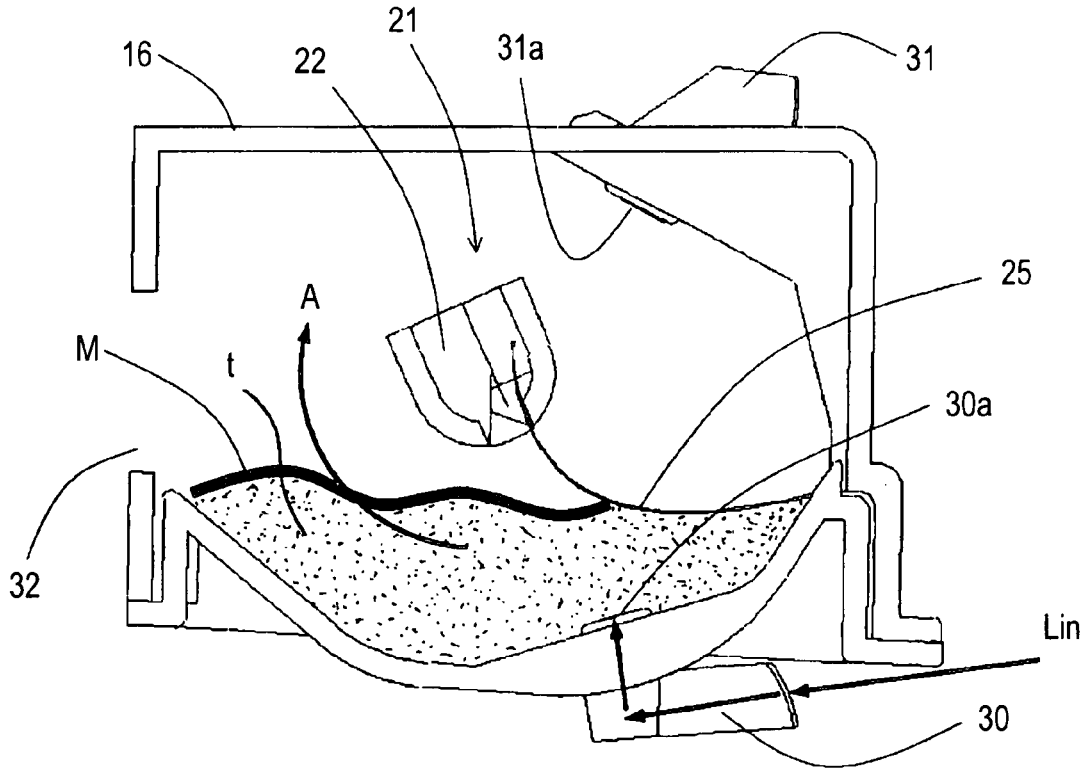
FIG. 16 is a schematic view (No. 2) for illustrating the developer storage portion in the third embodiment of the present invention.

Referring to FIG. 15, in the developer container 16, a pair of lenses 30 and 31 as a means for detecting the amount of the developer remaining in the developer container 16 are located. The beam of light $L_{in}$ outputted from the apparatus main assembly (unshown) reaches the surface 30*a* of the lens 30, located within the developer container 16, after being transmitted through the lens 30 while being reflected and deflected. Referring to FIG. 16, there is the developer t having accumulated on the lens 30, in the developer container 16; in other words, the surface 30*a* of the lens 30 is covered with the developer t. The internal state of the developer container 16 shown in FIG. 15 is the state which was realized as the conveying member 21 in the developer container 16, which was in the state shown in FIG. 16, was rotated (in direction indicated by arrow mark A in drawing) by the rotational force transmitted thereto from the driving force transmitting member. The conveying member 21 conveys the developer t to the development roller through the developer delivery opening 32. At the same time, one of the lengthwise edges of the flexible sheet 25 sweeps away the developer t on the surface 30*a* of the lens 30. As the internal state of the developer container 16 becomes as shown in FIG. 15, the beam of light $L_{in}$ having reached the surface 30*a* of the lens 30 travels through the internal space of the developer container 16, and reaches the surface 31*a* of the lens 31 fitted in the top wall of the developer container 16. It should be noted here that the surface 31*a* of the lens 30 has also been swept by the flexible sheet 25 as the conveying member 21 was rotated; the developer having adhered to the surface 31*a* of the lens 31 has been removed by the flexible sheet 25. In other words, in this state, the lens 31 is clean enough for the beam of light $L_{in}$ to transmit through it. After reaching the surface 31*a* of the lens 31, the beam of light $L_{in}$ travels through the lens 31, while being reflected and refracted, and returns as the beam of light Lout into the apparatus main assembly.

Generally, in the case of a method for detecting the remaining amount of the developer with the use of light transmission, the remaining amount of the developer is determined by detecting the length of time the beam of light $L_{in}$ outputted from the apparatus main assembly returns as the beam of light $L_{out}$ to the apparatus main assembly through the inside of the developer container during a single rotation of the conveying member 21. Thus, in the case of such a method for detecting the remaining amount of the developer in the developer container 16 as the above-described one, the flexible sheet 25 of the conveying member 21 is required to reliably wipe clean the surface 30*a* of the lens 30 so that the beam of light $L_{in}$ having reached the surface 30*a* of the lens 30 is allowed to travel through the inside of the developer container 16.

Although, in this embodiment, a method which uses the changes in the length in time of the light transmission through the developer container 16 as the method for detecting the remaining amount of the developer in the developer container 16, the present invention is also compatible with a method which uses an electrode in the form of a piece of a plate to detect the changes in the amount of static electricity, or a method which uses a piezoelectric element. In the case of these methods, the flexible sheet 25 wipes clean the detecting surface of the electrode for detecting the changes in the electrostatic capacity, or the detecting surface of the piezoelectric element.

Figure 17:
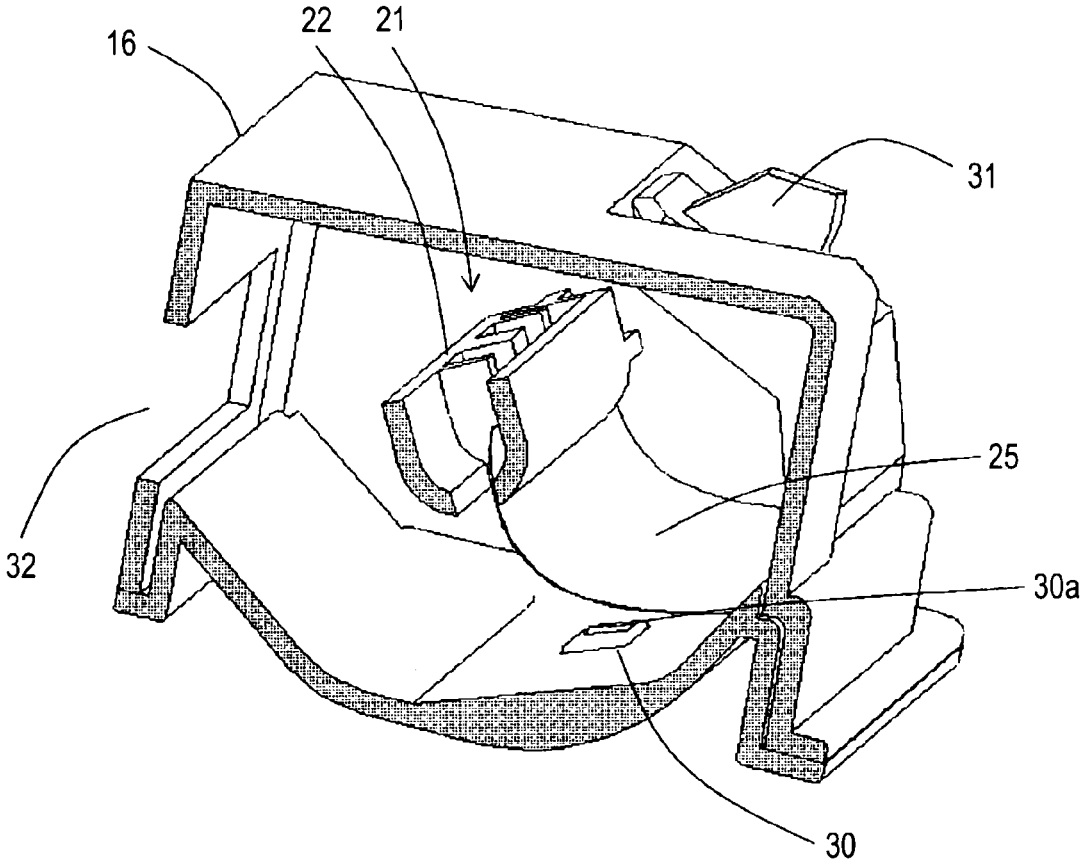
FIG. 17 is a sectional perspective view (No. 3) for illustrating the developer storage portion in the third embodiment of the present invention.

FIG. 17 is a sectional perspective view of the developer container 16, which is in the state shown in FIG. 16, showing the state thereof. FIG. 17 does not show the developer, but, the surface 30*a* of the lens 30 is covered as it is in FIG. 16; the developer has accumulated on the surface 30*a* of the lens 30. As the conveying member 21 in the state shown in FIG. 17 is rotated by the rotational driving force it receives through the driving force transmitting member, the state of the conveying member 21 changes into the state shown in FIG. 18.

Figure 18:
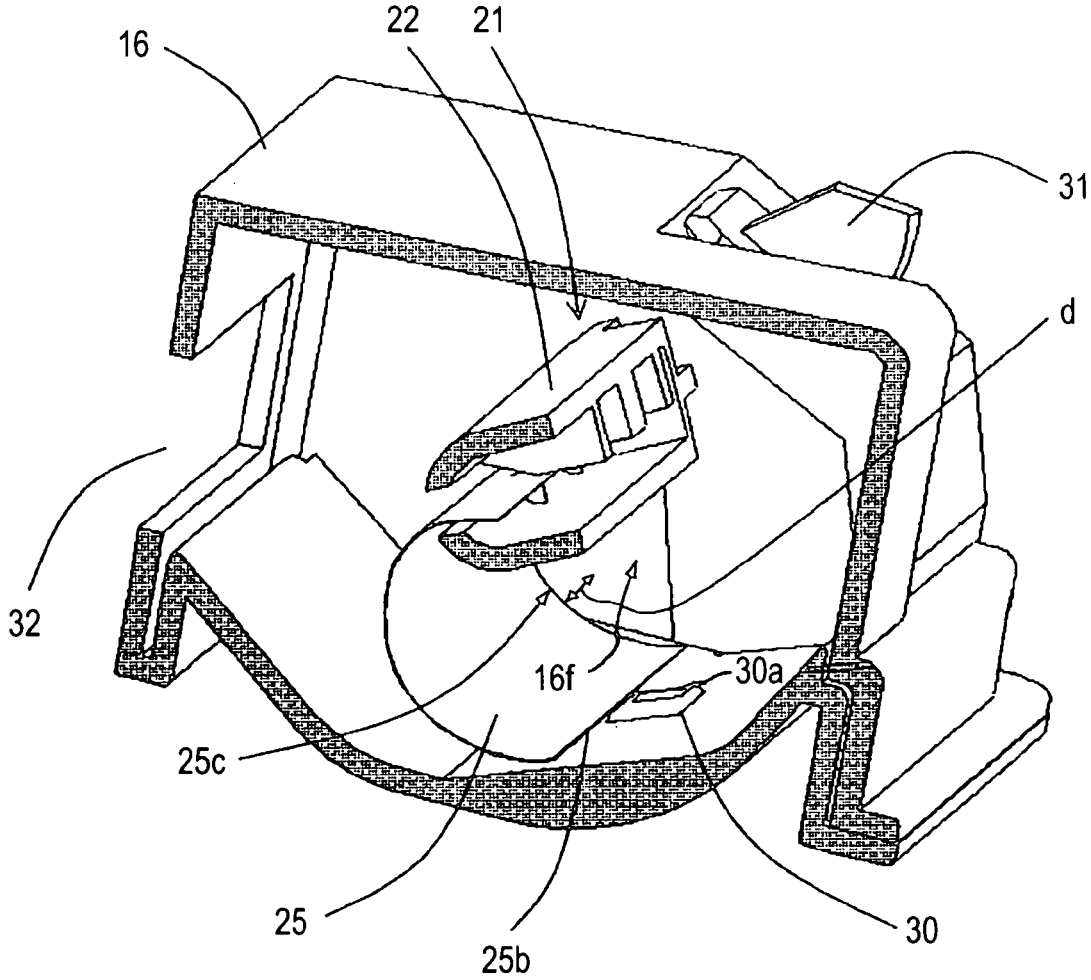
FIG. 18 is a sectional perspective view (No. 4) for illustrating the developer storage portion in the third embodiment of the present invention.

FIG. 18 is a sectional perspective view of the developer container 16 which is in the state shown in FIG. 15. In FIG. 18, the developer on the lens, 30 has been conveyed away by the flexible sheet 25 of the conveying member 21, and the surface 30*a* of the lens 30 has been wiped clean by the edge 25*b* of the flexible sheet 25; in other words, the developer has been removed from the surface 30*a*. Thus, the developer container 16 is in the state in which the light from the apparatus main assembly can travel through the developer container 16. If a gap d exists between the widthwise edges (ends in terms of lengthwise direction) of the flexible sheet 25 and corresponding side walls 16*f* of the developer container 16, a certain amount of the developer slips through the gap d as the developer is conveyed by the flexible sheet 25. Incidentally, the side walls 16*f* of the developer container 16 are roughly vertical. Thus, if the gap d exists, the developer sometimes reaches the surface 30*a* of the lens 30 while, or immediately after, the flexible sheet 25 cleans the surface 30*a* of the lens 30. In such a case, the light having reached the lens 30 is not allowed to be transmitted through the inside of the developer container 16, making it impossible to detect the remaining amount of the developer in the developer container 16. Therefore, it is desired that there is no gap d between the widthwise edges 25*c* of the flexible sheet 25 and the corresponding side walls 16*f* of the developer container 16. In other words, it is desired that after the installation of the conveying member 21 into the developer container 16, the widthwise edges 25*c* of the flexible sheet 25 remain flatly in contact with the side walls 16*f* of the developer container 16 as the conveying member 21 is rotated by the driving force transmitted thereto. Further, if the lengthwise edge 25*b*, that is, the opposite edge from the conveying shaft 22, of the flexible sheet 25 has a ripple, or ripples, while the lengthwise edge 25*b* cleans the surface 30*a* of the lens 30, a certain amount of the developer slips through the gaps created by the ripple; in other words, the flexible sheet 25 fails to satisfactorily clean the surface 30*a* of the lens 30. Therefore, it is desired that the lengthwise edge 25*b* of the flexible sheet 25 does not have a ripple, and does not ripple; the lengthwise edge 25*b* of the flexible sheet 25 is desired to be as straight as possible.

Next, in consideration of the above description of this embodiment, the conveying member 21 having such a flexible sheet (25), at least one of the widthwise edges 25*c* of which remains in contact with the side wall 16*f* of the developer container 16 as the conveying member 21 is rotated, will be described in comparison with the comparative example of the conveying member (21).

Figure 20:
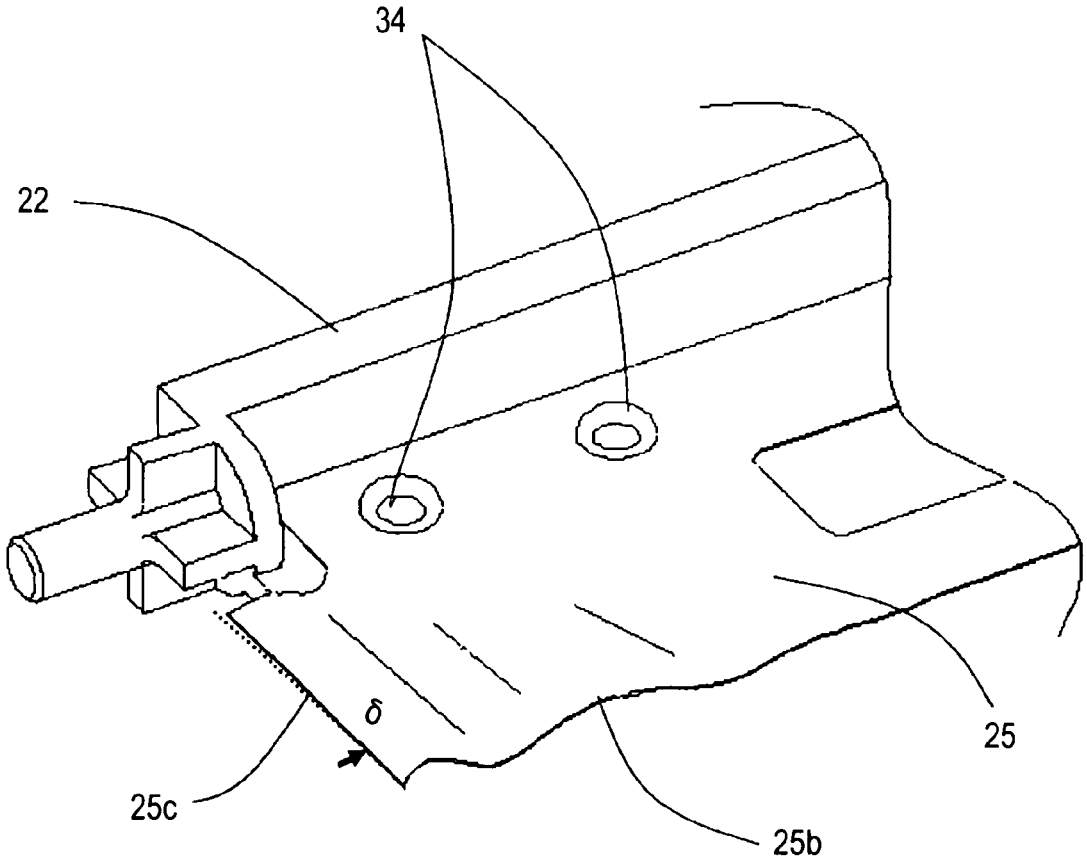
FIG. 20 is a perspective view (No. 2) for illustrating the comparative example of the developer conveying member.
Figure 21:
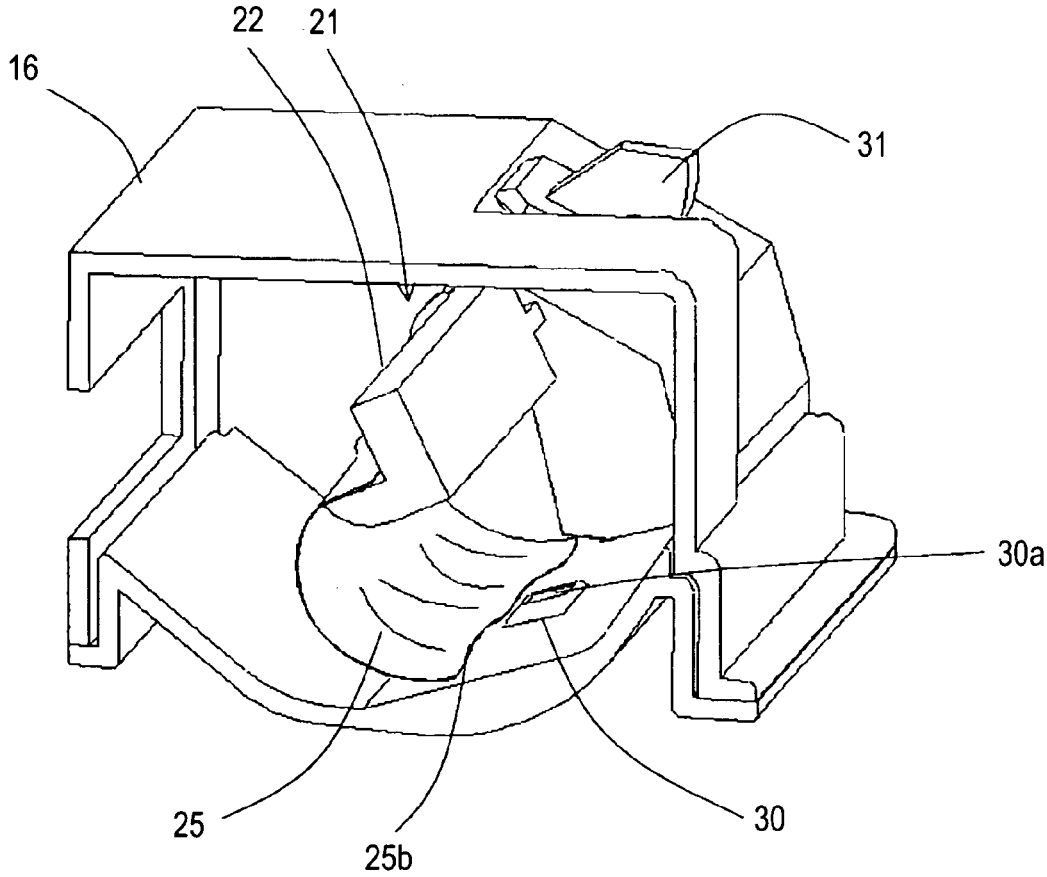
FIG. 21 is a perspective view for illustrating the comparative example of the developer container.

FIG. 19 shows one of the comparative examples of a developer conveying member (21), the developer conveying shaft 22 and flexible sheet 25 of which are firmly fixed to each other by thermal crimping, ultrasonic crimping, or the like. Designated by a reference numeral 34 is the joint between the two. As shown in FIG. 15, in the case of the method, in this comparative example, for attaching the flexible sheet 25 to the conveying shaft 22, the lengthwise edge 25*b* of the flexible sheet 25 sometimes becomes rippled as soon as the flexible sheet 25 is attached to the conveying shaft 22. The conveying member 21 shown in FIG. 19 is an example of the conveying member 21, the flexible sheet of which was carefully attached to the conveying shaft 22 in order to prevent the lengthwise edge 25*b* of the flexible sheet 25 from becoming rippled when attaching the flexible sheet 25 to the conveying shaft 22. In the case of this conveying member 21, the widthwise edge 25*c* of the flexible sheet 25 remains in contact with the side wall 16*f* of the developer container 16 while the conveying member 21 is rotated. In other words, the portion of the flexible sheet 25 in the adjacencies of the widthwise edge 25*c* of the flexible sheet 25 is enabled to hypothetically enter the side wall 16*f* of the developer container 16 by a distance of δ. FIG. 20 shows the comparative example of the developer conveying member 21 shown in FIG. 19, the portion of the flexible sheet 25 in the adjacencies of the widthwise edge 25*c* of the flexible sheet 25 is deformed by the width of δ. The flexible sheet 25 is firmly fixed to the conveying shaft 22, with the presence of no gap between the portions of the flexible sheet 25 and conveying shaft 22 in the joint 34. Therefore, the flexible sheet 25 has not deformed in the joint 34. Consequently, a ripple appears at the lengthwise edge 25*b* of the flexible sheet 25. This ripple which occurs along the lengthwise edge 25*b* of the flexible sheet 25 is undesirable from the standpoint of the developer conveyance, and the cleaning of the developer remainder detecting means, as described above. FIG. 21 shows the above-described comparative example of the conveying member 21 after its installation into the developer container 16. The flexible sheet 25 is bent in a manner to conform to the bottom wall of the developer container 16. In other words, the flexible sheet 25 is pressed upon the bottom wall of the developer container 16. Therefore, the ripple of the lengthwise edge 25*b* of the flexible sheet 25 is reduced to an amount much smaller than that shown in FIG. 20, but it is still there. In other words, the stress generated in the flexible sheet 25 is released only at the lengthwise edge 25*b*. Therefore, a certain amount of the ripple still remains at the lengthwise edge 25*b*.

Figure 22:
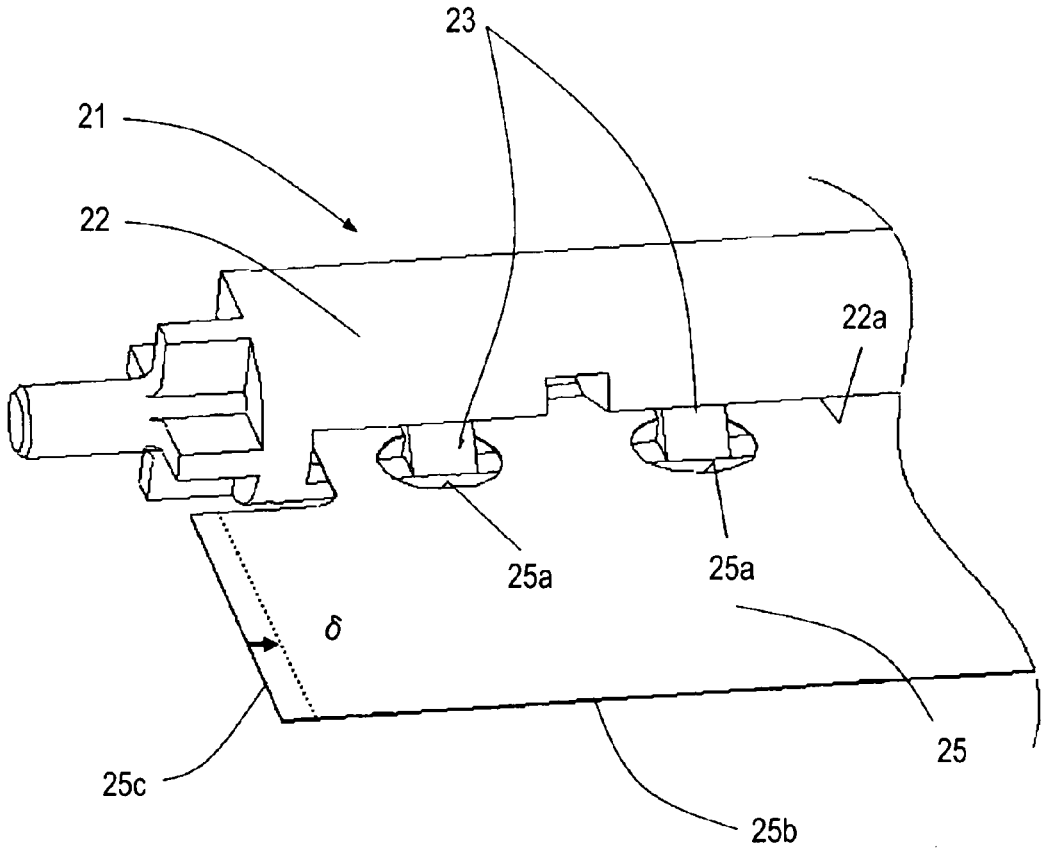
FIG. 22 is a perspective view (No. 1) for illustrating the developer conveying member in the third embodiment.
Figure 23:
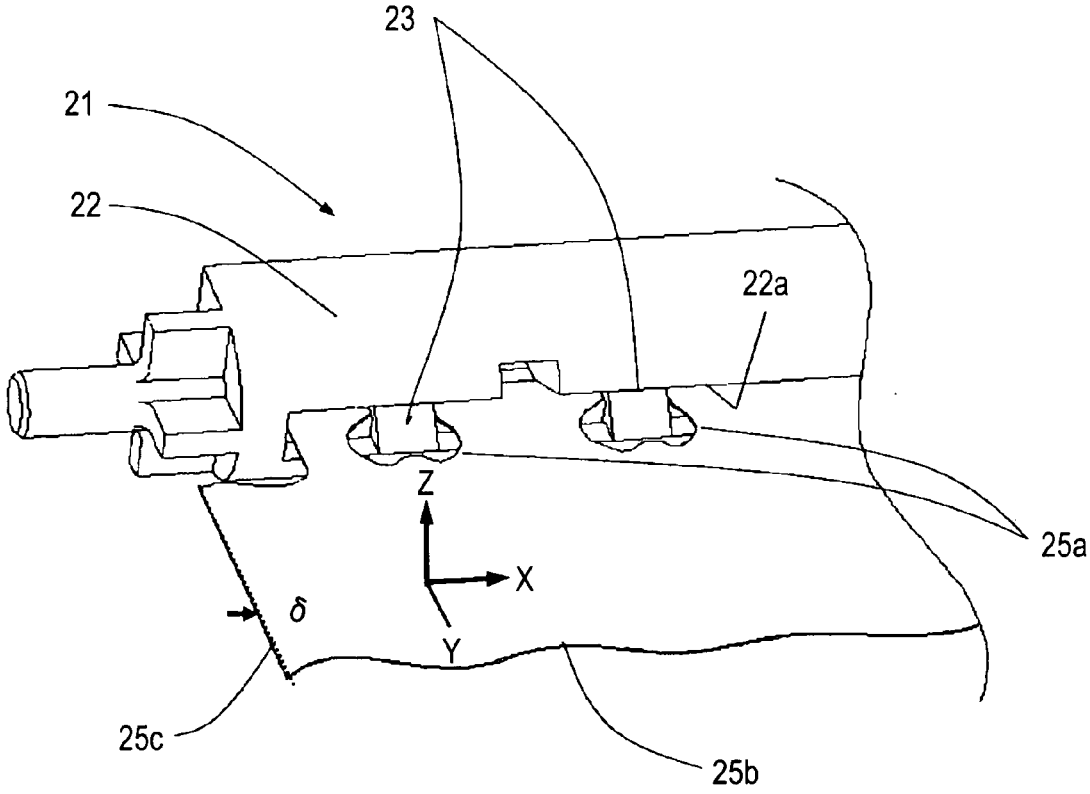
FIG. 23 is a perspective view (No. 2) for illustrating the developer conveying member in the third embodiment.

In comparison, FIG. 22 shows the conveying member 21 in this embodiment. Also in this embodiment, the flexible sheet 25 is anchored to the conveying shaft 22 as the flexible sheet anchoring claws 23 are put through the flexible sheet anchoring holes 25*a* of the flexible sheet 25, as it is in the above-described first embodiment. FIG. 23 shows the state of the conveying member 21 after the widthwise edge 25*c* of the conveying member 21, which was in the state shown in FIG. 22, was bent by the width of δ. In this embodiment, the flexible sheet 25 is not firmly attached to the conveying shaft 22; the flexible sheet anchoring claws 23 are simply put through the anchoring holes 25*a* of the flexible sheet 25, which are greater in size than the cross sections of the claws 23. Therefore, the flexible sheet 25 is allowed to move relative to the conveying shaft 22 in the lengthwise direction (parallel to axis X in drawing) of the flexible sheet 25, and also, the thickness (rotational) direction (parallel to axis Z in drawing) of the flexible sheet 25. Therefore, if the widthwise edge 25*c* of the flexible sheet 25 is bent by the width of δ, the stress generated in the flexible sheet 25 by the bending of the flexible sheet 25 can be released at the joint between the conveying shaft 22 and the flexible sheet 25, unlike what occurs in the case of the comparative example. Therefore, the amount of the ripple which might occur along the lengthwise edge 25*b* of the flexible sheet 25 is smaller than that in the case of the comparative example. Moreover, in this embodiment, the flexible sheet 25 is allowed to move relative to the conveying shaft 22 also in the widthwise direction (parallel to axis Y in drawing), making it much easier for the aforementioned stress to be released compared to the comparative example.

Figure 24:
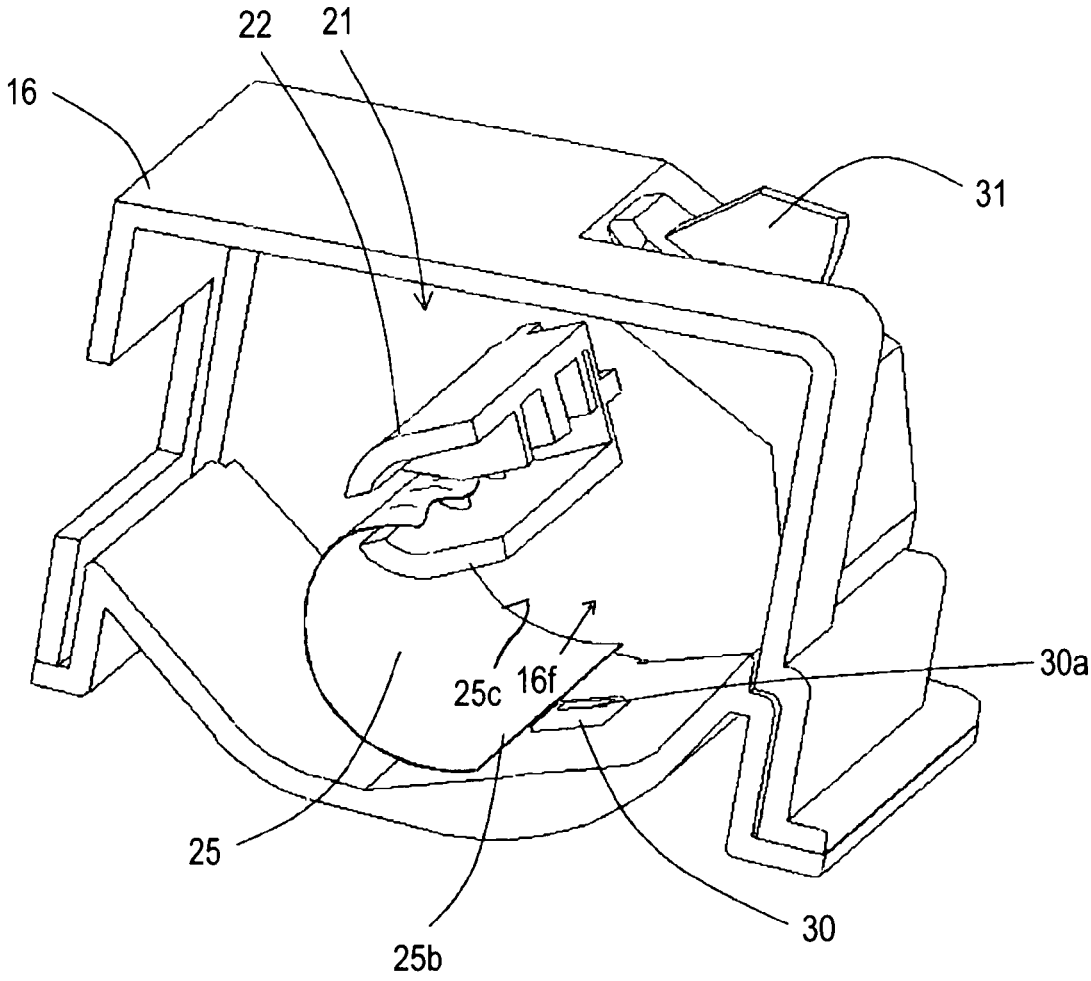
FIG. 24 is a perspective view for illustrating the developer container in the third embodiment.

Shown in FIG. 24 is the state of the developer conveying member 21 after the installation of the developer conveying member 21 into the developer container 16. In this state, the stress generated in the flexible sheet 25 can be released at the joint between the lengthwise edge 25*b*, or the free edge, of the flexible sheet 25, and the conveying shaft 22. Therefore, the portion of the flexible sheet 25 in the adjacencies of the lengthwise edge 25*b* of the flexible sheet 25 remains straight, conforming perfectly to the flat bottom wall of the developer container 16, even through the amount of the flexible sheet distortion which occurs at the joint between the flexible sheet 25 and the conveying shaft 22 is greater in this case than that in the case of the comparative example. Therefore, not only is the developer in the developer container 16 satisfactorily conveyed, but also, the surface of the means for detecting the remaining amount of the developer in the developer container 16 is satisfactorily cleaned.

In summary, according to this embodiment, even if the developer conveying member for conveying the developer in the developer container doubles as the means for cleaning the developer amount detecting means with which the developer container is to be provided, the amount by which the developer slips through the gaps between the developer conveying member and developer container walls can be made substantially smaller compared to the prior art. In other words, this embodiment of the present invention improve the developer conveying member in the function of conveying the developer, but also, in the function of cleaning the developer remainder amount detecting means.

Incidentally, in the above described first to third embodiments, "conveying the developer in the developer container" also means "stirring the developer in the developer container".

According to the present invention, it is possible to prevent the flexible sheet attached to the shaft from rippling.

Also according to the present invention, it is possible to prevent the flexible sheet attached to the shaft from rippling, even if the developer container is structured so that the flexible sheet comes into, or remains in contact with, the internal surfaces of the developer container.

Further, according to the present invention, it is possible to provide a developer conveying member capable of reliably conveying the developer in a developer container, a developing apparatus comprising such a developer conveying member, and a process cartridge comprising such a developing apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 261461/2004 filed Sep. 8, 2004, which is hereby incorporated by reference.

What is claimed is:

1. A developer feeding member mounting method for mounting, in a developer accommodating portion, a shaft rotatable relative to a developer accommodating portion, and a flexible sheet for engagement with the shaft to feed a developer in the developer accommodating portion by rotation, said method comprising:

a shaft mounting step of mounting the shaft in the developer accommodating portion;

a sheet inserting step of inserting a flexible sheet in a slit provided in the shaft which has been mounted in the developer accommodating portion; and an engaging step of engaging an engaging claw provided in the slit with an engaging hole provided in the flexible sheet to prevent disengagement of the flexible sheet from the shaft.

2. A method according to claim 1, wherein a retaining portion for preventing disengagement of the flexible sheet from the shaft is provided in the slit, and said sheet inserting step includes the step of inserting the flexible sheet into the slit along a first inclined surface of the engaging claw and a second inclined surface of the retaining portion.

* * * * *

UNITED STATES PATENT AND TRADEMARK OFFICE

CERTIFICATE OF CORRECTION

PATENT NO. : 7,224,925 B2
APPLICATION NO. : 10/960249
DATED : May 29, 2007
INVENTOR(S) : Masaaki Sato et al.

It is certified that error appears in the above-identified patent and that said Letters Patent is hereby corrected as shown below:

COLUMN 2
Line 14, “had” should read --has--.

COLUMN 5
Line 66, “slits 22a” should read --slit 22a--.

COLUMN 6
Line 10, “positioned,” should read --positioned.--.
Line 11, “in other words,” should read --In other words,--.
Line 12, “Each claw 23 is provided with a slanted portion” should be deleted.
Line 13, “23a” should be deleted.
Line 15, “portions” should read --portion-- and “23a” should be deleted.
Line 62, “edge” should read --The edge--.

COLUMN 8
Line 40, “directly” should be deleted.

COLUMN 10
Line 43, “(22a)” should read --22a--.
Line 58, “(22e),” should read --22e--.

COLUMN 12
Line 3, “Lout” should read --$L_{out}$--.
Line 44, “lens, 30” should read --lens 30--.

COLUMN 13
Line 18, “(25),” should read --25,--.
Line 22, “(21).” should read --21.--.
Line 24, “(21),” should read --21,--.

Signed and Sealed this
Twenty-fourth Day of May, 2011

David J. Kappos

David J. Kappos
*Director of the United States Patent and Trademark Office*

COLUMN 14

Line 20, “the thickness” should read --move in the thickness--.

Line 39, “edge, of” should read --edge of--.

Line 61, “improve” should read --improves--.